US009445633B2

(12) United States Patent
Tulloch et al.

(10) Patent No.: US 9,445,633 B2
(45) Date of Patent: Sep. 20, 2016

(54) PORTABLE ELECTRONIC DEVICE CONNECTOR

(71) Applicant: Apple Inc., Cupertino, CA (US)

(72) Inventors: Brandon B. Tulloch, Cupertino, CA (US); Gordon C. Cameron, Cupertino, CA (US); John Danby, Cupertino, CA (US); Amaury J. Heresztyn, Cupertino, CA (US); Nagarajan Kalyanasundaram, Cupertino, CA (US)

(73) Assignee: APPLE INC., Cupertino, CA (US)

( * ) Notice: Subject to any disclaimer, the term of this patent is extended or adjusted under 35 U.S.C. 154(b) by 0 days.

(21) Appl. No.: 14/703,575

(22) Filed: May 4, 2015

(65) Prior Publication Data

US 2016/0088880 A1 Mar. 31, 2016

Related U.S. Application Data

(60) Provisional application No. 62/057,658, filed on Sep. 30, 2014.

(51) Int. Cl.
*A41D 1/00* (2006.01)
*H01R 13/62* (2006.01)
(Continued)

(52) U.S. Cl.
CPC ..... *A41D 1/005* (2013.01); *H01R 13/6205* (2013.01); *H01R 13/639* (2013.01); *H01R 31/06* (2013.01); *H01R 13/621* (2013.01); *H01R 2201/20* (2013.01)

(58) Field of Classification Search
CPC ..... A41D 1/005; H01R 13/6205; H01H 13/639; G04G 17/06; G04G 21/00; G04G 47/00; G04G 21/04; G04G 15/006
USPC ..... 368/282, 10, 204, 281, 37; 439/37, 345, 439/660; 343/718
See application file for complete search history.

(56) References Cited

U.S. PATENT DOCUMENTS 3,973,706 A * 8/1976 Boyce ..... H01M 2/1044 224/165
6,155,841 A * 12/2000 Spanyar ..... G06F 1/163 368/10

(Continued)

FOREIGN PATENT DOCUMENTS

| | | |
|---|---|---|
| CN | 102856749 | 1/2013 |
| CN | 103280659 | 9/2013 |
| EP | 2230580 | 9/2010 |

OTHER PUBLICATIONS

Invitation to Pay Additional Fees, PCT/US2015/052823, 7 pages, Dec. 16, 2015.

*Primary Examiner* — Edwin A. Leon
(74) *Attorney, Agent, or Firm* — Brownstein Hyatt Farber Schreck, LLP

(57) ABSTRACT

In various embodiments, an affixing structure of a connector is configured to attach to an affixing structure interface of a portable electronic device that is configured to also couple to an attachment member. A connector plug including conductors coupled to an electrical conduit is coupled to the affixing structure. The conductors are configured to electrically connect to one or more electric components of the portable electronic device and the electrical conduit is configured to electrically connect to one or more diagnostic devices. In some embodiments, an attachment member may include one or more electronic components and spring pins or other conductors connectable to a wearable device. The attachment member additionally includes a connector operable to connect the wearable device to another electronic device.

29 Claims, 25 Drawing Sheets

(51) Int. Cl.

| | |
|---|---|
| ***H01R 13/639*** | (2006.01) |
| ***H01R 31/06*** | (2006.01) |
| *H01R 13/621* | (2006.01) |

(56) References Cited

U.S. PATENT DOCUMENTS

| | | | | |
|---|---|---|---|---|
| 6,158,884 | A | 12/2000 | Lebby et al. | |
| 6,454,608 | B1 * | 9/2002 | Kitahara | H01R 13/2421 439/358 |
| 6,459,890 | B1 * | 10/2002 | Kim | G04G 17/00 368/204 |
| 6,619,835 | B2 * | 9/2003 | Kita | A44C 5/0015 368/10 |
| 6,854,978 | B2 * | 2/2005 | Noirjean | H01Q 1/273 343/718 |
| 7,513,038 | B2 | 4/2009 | Koh | |
| 7,972,160 | B2 | 7/2011 | Jeong et al. | |
| 8,414,337 | B2 | 4/2013 | Villareal et al. | |
| 8,467,270 | B2 | 6/2013 | Gossweiler, III et al. | |
| 8,976,628 | B2 * | 3/2015 | Leoni | G04G 21/00 368/10 |
| 2007/0064542 | A1 * | 3/2007 | Fukushima | G04B 37/1486 368/282 |

* cited by examiner

PORTABLE ELECTRONIC DEVICE CONNECTOR

CROSS-REFERENCE TO RELATED APPLICATION

This application is a nonprovisional patent application of and claims the benefit to U.S. Provisional Patent Application No. 62/057,658, filed Sep. 30, 2014 and titled "Portable Electronic Device Connector," the disclosure of which is hereby incorporated herein by reference in its entirety.

TECHNICAL FIELD

This disclosure relates generally to portable electronic devices, and more specifically to a connector for a portable electronic device.

BACKGROUND

Portable electronic devices include a wide variety of different electronic devices designed to be easily transported by a user. Such electronic devices may include smart phones, digital media players, cellular telephones, mobile computing devices, wearable devices, tablet computing devices, health and fitness monitors, laptop computing devices, and so on.

Manufacturers may be limited by size, weight, and other constraints when designing portable electronic devices to be easily transported. Meeting such constraints may involve omitting components from the portable electronic devices that might otherwise be useful or using smaller but less powerful versions of components.

SUMMARY

The present disclosure details systems, apparatuses, and methods related to connectors for portable electronic devices. In some embodiments, an affixing structure of a connector may be configured to attach to an affixing structure interface of a portable electronic device that is configured to also couple the portable electronic device to an attachment member. A connector plug including spring pins or other conductors coupled to an electrical conduit may be coupled to the affixing structure. The spring pins may electrically connect to one or more electric components of the portable electronic device and the electrical conduit may electrically connect to one or more diagnostic and/or other electronic devices.

In some embodiments, an attachment member may include one or more electronic components and spring pins or other conductors connectable to a wearable device. In some embodiments, the attachment member may additionally include a connector operable to connect the wearable device to another electronic device. Such connection may allow transfer of power and/or communications between the attachment member and the electronic device and/or between the wearable device and the electronic device via the attachment member.

In various embodiments, a connector for a portable electronic device includes an affixing structure configured to attach to an affixing structure interface of a portable electronic device. The affixing structure interface may be configured to couple the portable electronic device to an attachment member. The connector may also include a connector plug coupled to the affixing structure. The connector plug may include conductors coupled to an electrical conduit. The conductors may be configured to electrically connect to an electronic component of the portable electronic device when the affixing structure is attached to affixing structure interface and the electrical conduit is configured to electrically connect to a diagnostic device.

In some embodiments, a system for connecting an electronic device to a wearable device may include an affixing structure configured to insert into a channel of a wearable device and a connector plug coupled to the affixing structure. The connector plug may include a pin coupled to an electrical conduit. The pin may be configured to electrically connect to an electronic component of the wearable device when the affixing structure is inserted into the channel and the electrical conduit is configured to electrically connect to an electronic device.

In one or more embodiments, an electronic band for a wearable device may include a band segment including an electronic component; an affixing structure, coupled to the band segment, configured to insert into a channel of a wearable device; and a conductor, coupled to the affixing structure, electrically connected to the electronic component of the band segment. The conductor may be configured to electrically connect the electronic component of the band segment to an electronic component of the wearable device when the affixing structure is inserted into the channel.

It is to be understood that both the foregoing general description and the following detailed description are for purposes of example and explanation and do not necessarily limit the present disclosure. The accompanying drawings, which are incorporated in and constitute a part of the specification, illustrate subject matter of the disclosure. Together, the descriptions and the drawings serve to explain the principles of the disclosure.

DETAILED DESCRIPTION

Figure 1A:
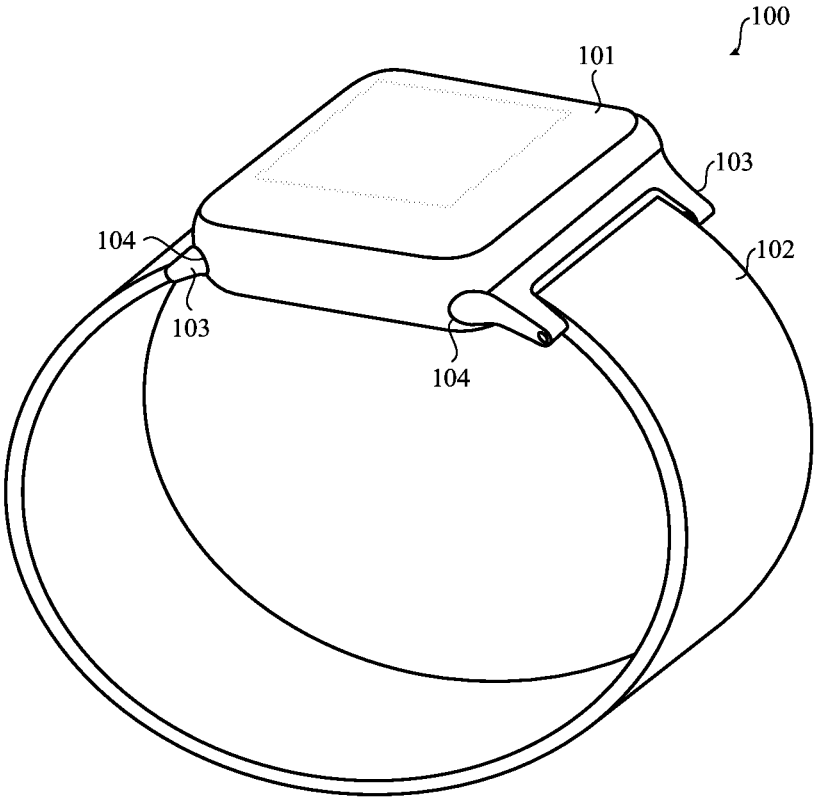
FIG. 1A is an isometric view of an electronic device having an attachment member and an affixing structure.

The description that follows includes sample systems, methods, and computer program products that embody various elements of the present disclosure. However, it should be understood that the described disclosure may be practiced in a variety of forms in addition to those described herein.

The present disclosure details systems, apparatuses, and methods related to connectors for portable electronic devices. In various embodiments, an affixing structure ("lug") of a connector may be configured to attach to an affixing structure interface ("lug interface") of an electronic device that is configured to also couple the electronic device to an attachment member, such as a band. Conductors of the connector may electrically connect to the electronic device when the affixing structure is attached, facilitating electrical communication between the electronic device and another electronic device using the connector. This electrical communication may enable a variety of different interactions with the electronic device, such as obtaining data from the electronic device, transferring data to the electronic device, obtaining diagnostic information from the electronic device, instructing the electronic device to perform various actions such as running diagnostic tests, and so on.

For example, the affixing structure may be inserted into a channel of a wearable device that is configured to couple the wearable device to a band or band segment. A connector plug, which may include spring pins or other conductors coupled to an electrical conduit, may be coupled to the affixing structure. The spring pins may be coupled to the connector plug by inserting the spring pins through an aperture that extends through the affixing structure. The spring pins may electrically connect to one or more electric components of the portable electronic device and the electrical conduit may electrically connect to one or more diagnostic devices. In this way, the connector may be used to connect the portable electronic device and the diagnostic device so that the diagnostic device can perform various functions such as resetting the portable electronic device to an initial factory configuration.

In some implementations, the spring pins or other conductors may electrically connect to the electronic component of the portable electronic device via an aperture in the affixing structure interface. The affixing structure interface aperture may be covered with a seal, which may be formed of epoxy and/or other polymer, which may be destructively removed prior to connection of the spring pins. In this way, contact pads and/or other components of the affixing structure interface aperture may be protected from corrosion when the connector is not being utilized. Further, support personnel may be able to connect the connector to the portable electronic device without enabling users of the portable electronic device to do so.

In various embodiments, an attachment member may include one or more electronic components and spring pins or other conductors. For example, inserting an affixing structure of a band or band segment to a channel of a wearable device may electrically connect spring pins of the band affixing structure to the wearable device, thereby electrically connecting the electronic component of the band or band segment to the electronic component of the wearable device. In some embodiments, the attachment member may additionally include a connector operable to connect the wearable device to another electronic device. Such connection may allow transfer of power and/or communications between the attachment member and the electronic device and/or between the wearable device and the electronic device via the attachment member.

In some embodiments, an attachment member such as a band may connect to a wearable device. The attachment member may include a connector positioned within a clasp that is operable to connect the attachment member to another electronic device to allow transfer of power and/or communications. The connector may be moveable between an obscured and a revealed position.

For example, a band or other attachment member may include a first portion with a connector positioned on an end and a second portion with a cavity defined in an end. The two ends may be connectable, such as via one or more magnets. Connecting the two ends may insert the connector into the cavity, thus obscuring the connector. Disconnecting the two ends may remove the connector from the cavity, thus revealing the connector.

By way of another example, a band or other attachment member may include multiple portions joined by a clasp mechanism. The clasp mechanism may include clasp portions that are magnetically attachable to each other. The clasp portions may each include one or more magnetic elements. One or more of the magnetic elements may be manipulated between first and second positions. In the first position, the magnets may be operable to attract and/or attach the clasp portions. In the second position, the magnets may no longer attract and/or attach the clasp portions, and may cause the clasp portions to repel each other. One or more of the clasp portions may include a connector positioned in a cavity facing where the clasp portions connect. As such, connecting the clasp portions may obscure the connector and disconnecting the clasp portions may reveal the connector.

By way of a third example, a band or other attachment member may include a clasp mechanism that is operable to transition between an extended and a fastened configuration to extend and/or contract the length of the band without detaching. The clasp mechanism may include multiple extender portions and at least one fastening portion that are flexibly connected to one another. The extender portions may move to fold into and be fastened by the fastening portion when transitioning to the fastened configuration. The fastening portion may unfasten and allow the extender portions to fold out from the fastening portion when transitioning to the extended configuration. A connector may be coupled to one of the extender portions or the fastening portion such that transitioning to the fastened configuration obscures the connector within the clasp mechanism and transitioning to the extended configuration reveals the connector.

FIG. 1A is an isometric view of a sample electronic device 100. As illustrated, the electronic device 100 is shown as a wearable device 101 coupled to an attachment member 102 (shown as a band) via an band lugs 103 or other affixing structure slid into lug interface channels 104 or other affixing structure interface of the wearable device 101. However, it is understood that this is an example. In various implementations the wearable device 101 may be any kind of portable and/or other electronic device, the lug interface channels 104 may be an interface other than a set of channels, and/or the attachment member 102 may be any kind of attachment member that may be attached to the wearable device 101 using a variety of different mechanisms without departing from the scope of the present disclosure. For example, the electronic device 100 may be a mobile phone, tablet computing device, other wearable device (e.g., glasses, jewelry, and the like). As another example, the lug interface channels 104 may be a single aperture rather than a group of channels. As still another example, the attachment member 102 may be a stretchable fabric.

The wearable device 101 may include various electronic components not shown. Such components may include one or more processing units, one or more input/output components, one or more communication components, and/or one or more non-transitory storage media (which may take the form of, but is not limited to, a magnetic storage medium; optical storage medium; magneto-optical storage medium; read only memory; random access memory; erasable programmable memory; flash memory; and so on). Generally, these components are not illustrated for purposes of clarity and/or simplicity.

The wearable device 101 may communicate wirelessly with one or more electronic devices. For example, the wearable device may communicate using one or more WiFi antennas, Bluetooth antennas, near field communication antennas, cellular antennas, and so on. Further, the wearable device may communicate either wirelessly or in a wired fashion with electronic components in either or both of the lug and band, if either or both incorporate electronic components.

Wireless communication may not be suitable for all purposes for which electronic devices that communicate with the wearable device 101. For example, writing or reading large amounts of data (such as migrating all data of an electronic device to a replacement device) may be slower over a wireless communication connection than over some wired communication connections.

By way of another example, wireless communication may not be suitable for diagnostic and/or other technical support activities. Wireless communications may be accomplished through wireless communication components of the wearable device 101 and thus not allow direct communication with other hardware components for purposes of obtaining diagnostic information, flashing firmware, and/or other activities. For instance, failure of a wireless communication component could prevent any diagnostic information from being obtained and therefore cause support personnel to be unable to determine precisely which component of the wearable device has failed.

Figure 1B:
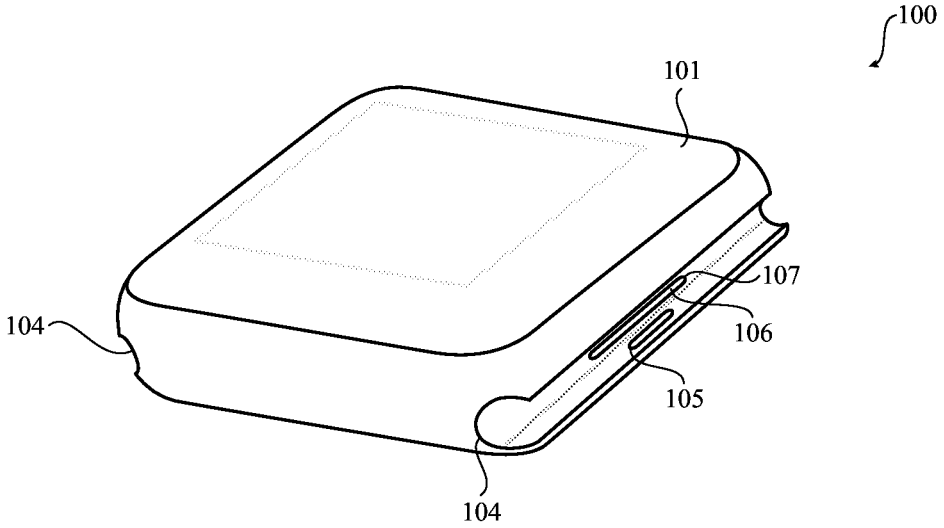
FIG. 1B shows the view of FIG. 1A with an attachment member removed.

FIG. 1B shows the view of FIG. 1A with the attachment member 102 removed. As illustrated, the lug interface channel 104 of the wearable device 101 may include a key aperture 105 that extends from the inside of the lug interface channel 104 to the underside of the wearable device 101. Further, the lug interface channel 104 may include an access aperture 107 that extends into the wearable device 101. As illustrated, in some implementations the access aperture 107 may be blocked with a seal 106. The seal 106 may be formed of a material such as epoxy and/or other polymer that may be destructively removed. In other words, the seal 106 may be removed to expose the access aperture 107, but removing the seal 106 may destroy the seal 106.

Figure 1C:
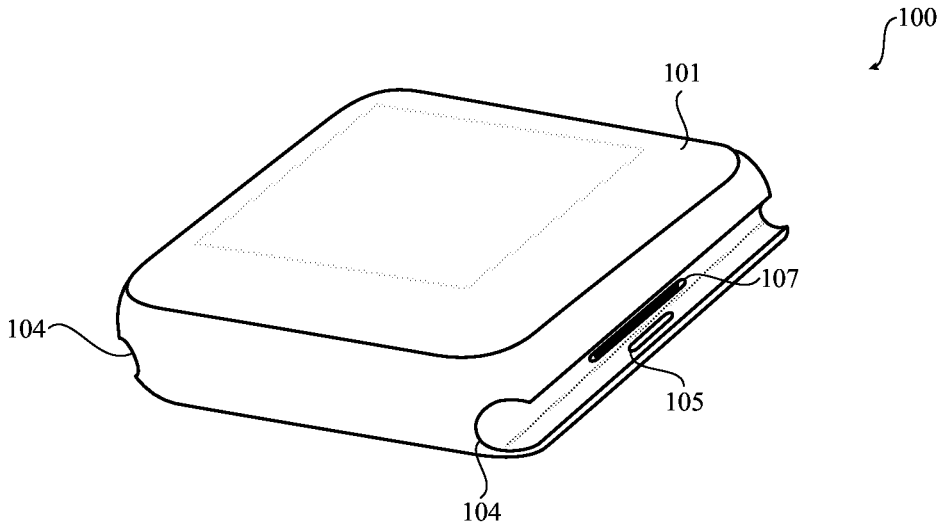
FIG. 1C shows the view of FIG. 1B after a seal has been removed.

In this way, support personnel may be able to remove the seal 106 to access the access aperture 107, but users of the wearable device 101 may not be able to do so without leaving evidence of that access. For example, one or more warrantees related to the wearable device 101 may be voided if the seal 106 is removed. FIG. 1C shows the view of FIG. 1B after the seal 106 blocking the access aperture 107 has been destructively removed.

Figure 2A:
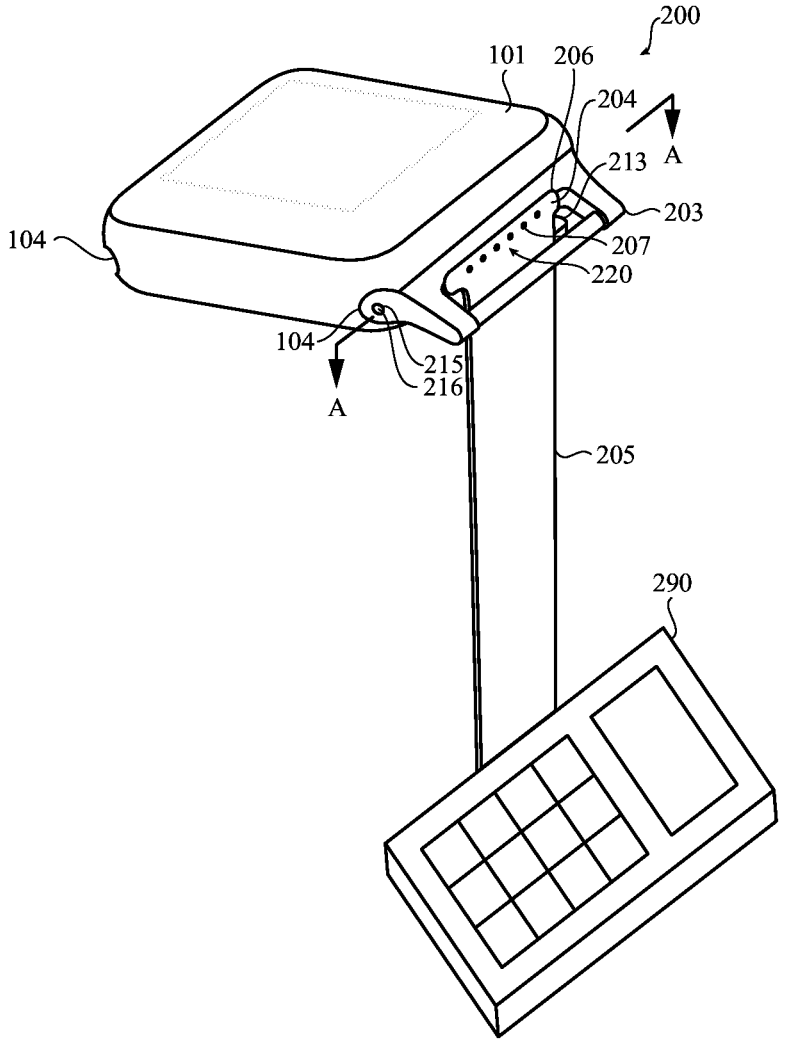
FIG. 2A is an isometric view illustrating an example system for connecting a diagnostic device to an electronic device using a connector.
Figure 2B:
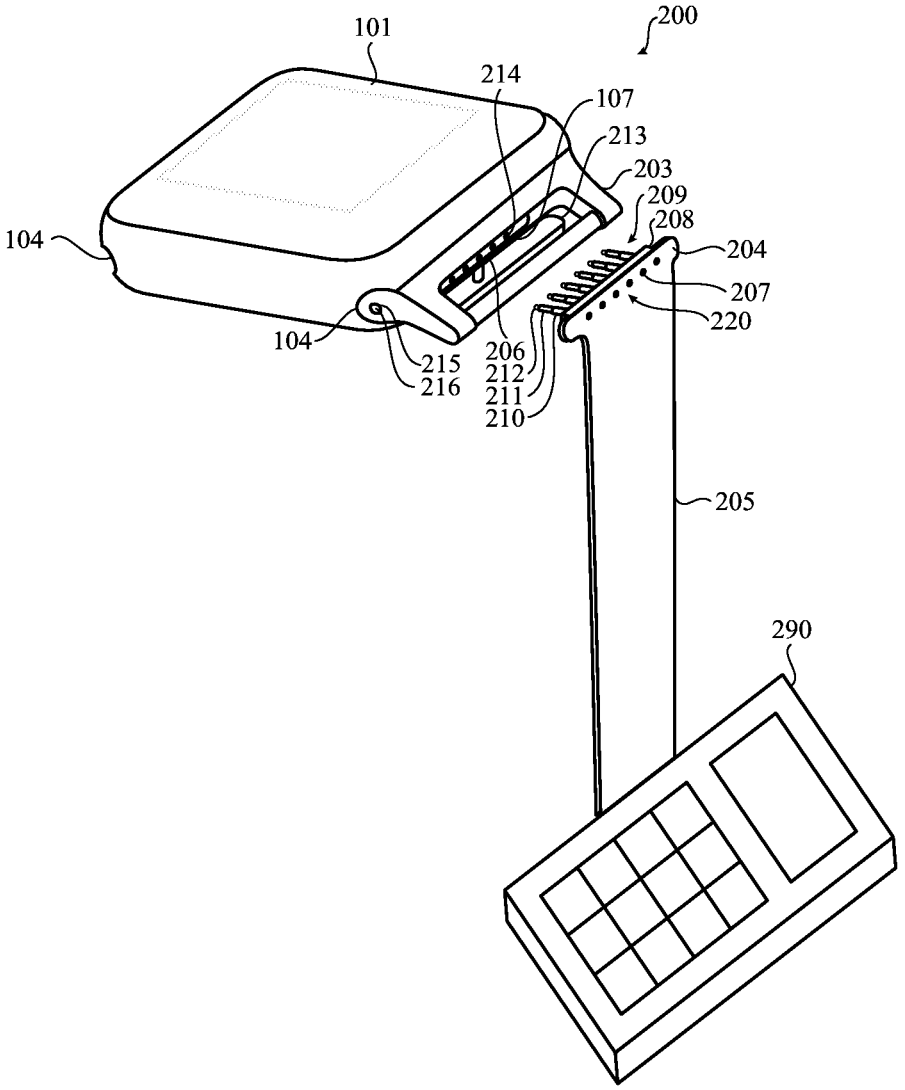
FIG. 2B illustrates the example system of FIG. 2A with the connector removed from the electronic device.

FIG. 2A is an isometric view illustrating an example system 200 for connecting a diagnostic device 290 (or other electronic device) to the wearable device 101 using a connector (including connector lug 203 and connector plug 220). FIG. 2B illustrates the example system 200 of FIG. 2A after the connector is removed from the wearable device 101.

With reference to FIGS. 2A and 2B, a connector lug 203 may be inserted into the lug interface channel 104. The connector lug 203 may include various locking mechanisms (such as tab screw 216, tab screw hole 215, tabs 401, and/or key 213 discussed below) for locking the connector lug 203 in place to the lug interface channel 104. A connector plug 220 that includes spring pins 209 or other conductors coupled to a flex circuit 205 and/or other electrical conduit or attachment member (which may electrically connect to the diagnostic device 290 and/or another electronic device) may be coupled to the connector lug 203.

The spring pins 209 may be mounted in a spring pin block 208 that couples to the flex circuit 205 by conductive material 207 that extends from the spring pins 209 through the spring pin block 208 and the flex circuit to a stiffener 204. The spring pins 209 may include moveable pins 211 that are forceable into pin collars 210 but are spring biased (see FIG. 3B) to project from the pin collars 210. The spring pins 209 may also include contacts 212 positioned on the moveable pins 211 that are electrically connected to the conductive material 207 (see FIG. 3B). Though six spring pins 209 are shown, it is understood that this is an example and that other numbers of spring pins are possible and contemplated without departing from the scope of the present disclosure.

A lug aperture 206 may be aligned with the access aperture 107 such that the connector plug 220 may be at least partially inserted into the lug aperture 206 and access aperture 107 to connect the contacts 212 to contact pads 214 positioned inside the access aperture 107.

Thus, the connector may be used to electrically connect the diagnostic device 290 (and/or another electronic device) to the wearable device 101. Such connection may be usable by the diagnostic device and/or another electronic device to interact with the wearable device 101 in a variety of ways. For example, the diagnostic device 290 may: obtain diagnostic information from one or more electronic components of the wearable device 101, reset the wearable device 101 and/or one or more components to an initial configuration (such as a factory configuration), obtain data stored by one or more components of the wearable device 101, write data to one or more components of the wearable device 101, flash firmware of the wearable device 101, instruct the wearable device 101 to perform one or more operations, and/or perform various other activities.

Although the connector is illustrated and described above as usable to connect the wearable device 101 to the diagnostic device 290, it is understood that this is an example. In various implementations, the connector may be usable to connect the wearable device 101 to any electronic device (such as a desktop computing device, a laptop computing device, a tablet computing device, a mobile computing device, a smart phone, a digital media player, and/or any other electronic device). Such connection may be usable for a variety of purposes such as data transmission between the wearable device 101 and the electronic device, control of the devices by the other, charging of one of the devices by the other, and/or any other action that may be performed by electrically and/or communicably coupling the devices.

Figure 3A:
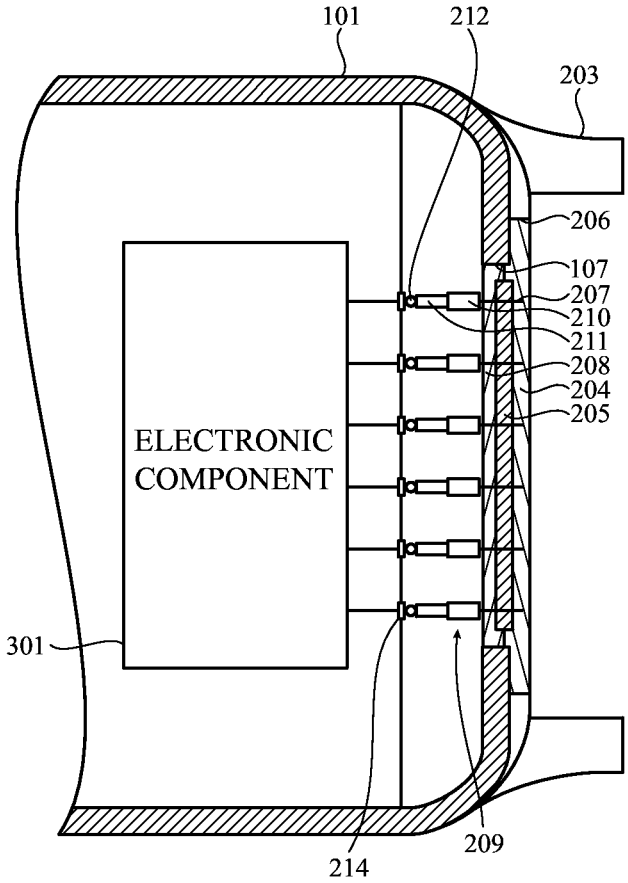
FIG. 3A is a cross sectional schematic view of a connection between the connector and the electronic device, taken along line A-A of FIG. 2A.

FIG. 3A is a cross sectional schematic view of the connection between the connector and the wearable device 101, taken along line A-A of FIG. 2A. As illustrated, inserting the spring pins 209 into the lug aperture 206 and the access aperture 107 may connect the contacts 212 to contact pads 214. This may electrically connect the flex circuit 205 (and/or other electrical conduit and/or attachment member) to one or more electronic components 301 of the wearable device.

As illustrated, the access aperture 107 may be a single aperture in a housing of the wearable device 101 through which the spring pins 209 may be inserted. However, it is understood that this is an example and that in various implementations the access aperture 107 may include separate apertures for each of the spring pins 209. In some implementations, the housing of the wearable device 101 may be formed of metal and the spring pins 209 may be insulated from the metal housing.

As also illustrated, the spring pins 209 may be electrically isolated from the housing of the wearable device 101 by spacing between the spring pins 209 and the housing defined by the access aperture 107. However, in various implementations the access aperture 107 may be configured to not define space between the spring pins 209 and the housing of the wearable device 101. In such implementations the spring pins 209 may include insulating material on the sides of the spring pins 209 positioned between conductive portions of the spring pins 209 (such as the contacts 212) and the housing of the wearable device 101 to electrically isolate the spring pins 209 from the housing.

As further illustrated, the connector plug 220 may have a stepped profile such that the spring pin block 208 has one or more smaller dimensions (width, as shown) than the stiffener 204. As shown, at least a portion of the stiffener 204 may fit within the lug aperture 206, but not within the access aperture 107. However, as also shown, some or all of the spring pin block 208 may fit within the access aperture 107. As such, the spring pin block 208 may bear any shear force or lateral force exerted on the connector plug 220 or between the connector plug 220 and the wearable device 101. In this way, the spring pins 209 may not be loaded with such force and damage to the spring pins 209 may be prevented.

Figure 3B:
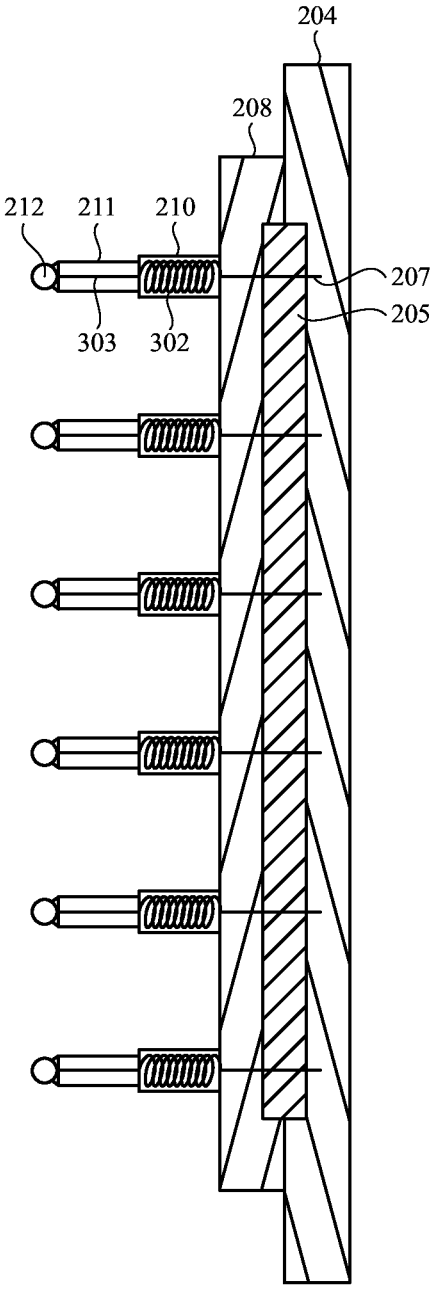
FIG. 3B is a close-up view of the connector of FIG. 3A with components removed for clarity.

FIG. 3B is a close-up view of the connector of FIG. 3A with components removed for clarity. As illustrated, the moveable pins 211 may extended into cavities defined by the pin collars 210 by compressing conductive springs 302. The contacts 212 may be electrically connected to the flex circuit 205 (and/or other electrical conduit and/or attachment member) by conductors 303 inside the moveable pins 211 that connect the contacts 212 to the conductive springs 302 and the conductive material 207 that connects the conductive springs 302 through the spring pin block 208 to the flex circuit 205 (and/or other electrical conduit and/or attachment member).

Although the spring pins 209 are illustrated as including six pins mounted to the spring pin block 208, it is understood that this is an example and that various numbers of spring pins 209 (and/or other conductors other than spring pins 209) may be used without departing from the scope of the present disclosure. In various implementations, the spring pins 209 may be used to form a variety of different electrical and/or communication connections. For example, the spring pins 209 may be configured to be one or more power pins, one or more ground pins, one or more communication pins (such as one or more universal serial bus pairs, one or more serial wire debug pairs, and so on), and so on without departing from the scope of the present disclosure.

Figure 4A:
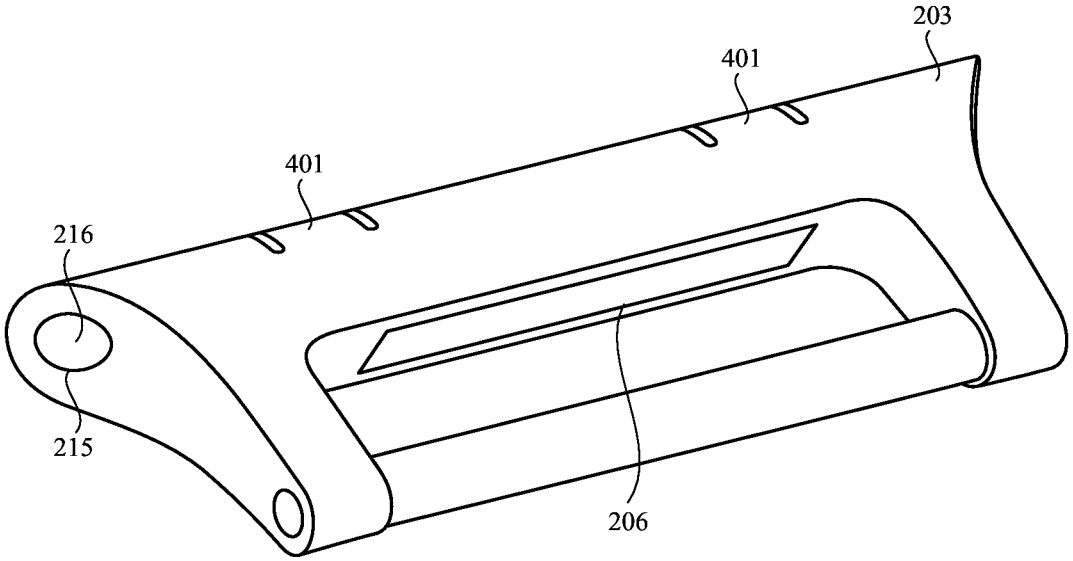
FIG. 4A is an isometric top view of the affixing structure of FIG. 2A shown with a tab screw removed.
Figure 4B:
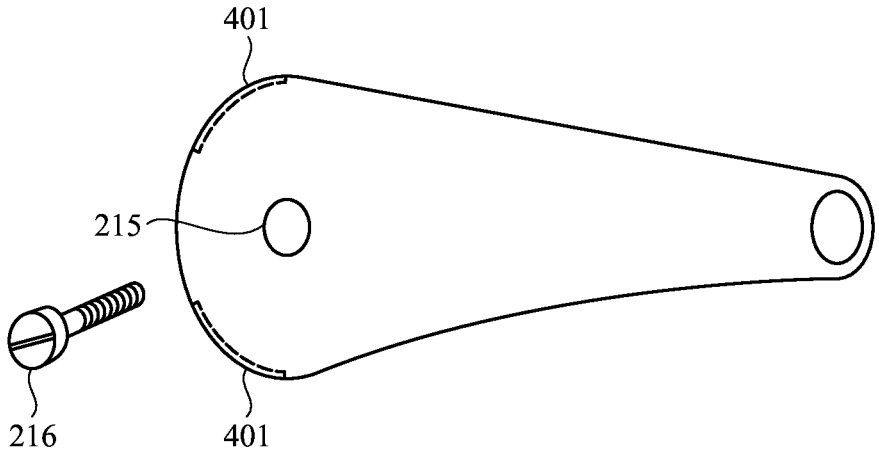
FIG. 4B is a side view of the affixing structure of FIG. 2A shown with the tab screw removed.
Figure 4C:
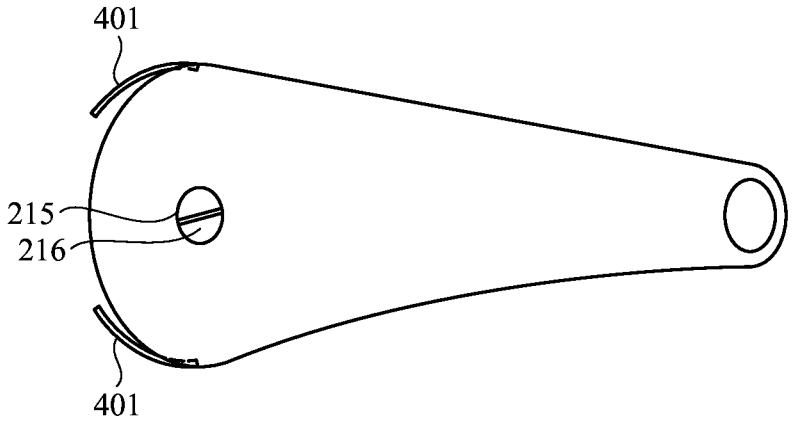
FIG. 4C illustrates the view of FIG. 4B after insertion of the tab screw.

As discussed above, the connector lug 203 may include various locking mechanisms for locking the connector lug 203 in place to the lug interface channel 104. For example, as illustrated in FIG. 4, the connector lug 203 may include tabs 401. With reference to FIGS. 4B-4C, when a tab screw 216 is not present in a tab screw hole 215, the tabs 401 may be positioned flat against the connector lug 203. However, when the tab screw 216 is inserted into the tab screw hole 215, the tabs 401 may be driven outward from the connector lug 203. FIG. 4B is a side view of the lug 103 of FIG. 2A shown with the tab screw 216 removed and the tabs 401 positioned flat against the connector lug 203. FIG. 4C illustrates the view of FIG. 4B after insertion of the tab screw 216, driving the tabs 401 outward. When the tabs 401 are driven outward, the tabs 401 may press against and frictionally engage the lug interface channel 104, locking the connector lug 203 to the lug interface channel 104.

Figure 4D:
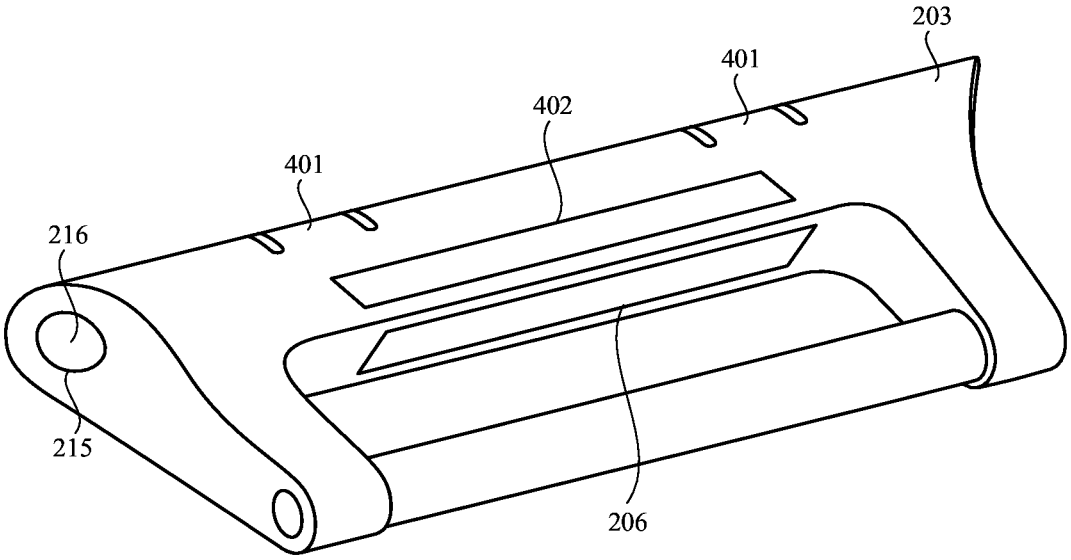
FIG. 4D is an isometric bottom view of the affixing structure of FIG. 2A.

By way of another example, as illustrated in FIG. 4D, the bottom of the connector lug 203 may include a key hole 402. As illustrated in FIG. 2B with reference to FIG. 1B, the key 213 may be inserted through the key aperture 105 of the lug interface channel 104 and into the key hole 402 of the connector lug 203, locking the connector lug 203 in place with respect to the lug interface channel 104.

However, it is understood that the tabs 401 and the key 213 are examples of how the connector lug 203 may be locked in place with respect to the lug interface channel 104. In various implementations, locking mechanisms of various kinds and configurations may be used to perform such locking functions without departing from the scope of the present disclosure.

With reference again to FIGS. 2A and 2B, the connector lug 203 may be attached to the lug interface channel 104 and locked in place. The connector plug 220 may be coupled to the connector lug 203, electrically connecting the spring pins 209 to the wearable device 101, and the flex circuit 205 (and/or other electrical conduit and/or attachment member) may be electrically connected to the diagnostic device 290 and/or other electronic device. In this way, the connector may be used to electrically connect the wearable device 101 to the diagnostic device 290 and/or other electronic device.

Although the connector plug 220 is illustrated and discussed above as utilizing spring pins 209, it is understood that this is an example. In various implementations, any conductors may be utilized with the connector plug 220 without departing from the scope of the present disclosure. For example, telescoping pins may be used in some embodiments. In other embodiments, rigid conductors may be used. In still other embodiments, the connector plug 220 may utilize magnetic conductive pins operable to be pulled into the access aperture 107 by magnets of the wearable device 101. Any kind of conductor may be utilized with the connector plug 220 without departing from the scope of the present disclosure.

Figure 5A:
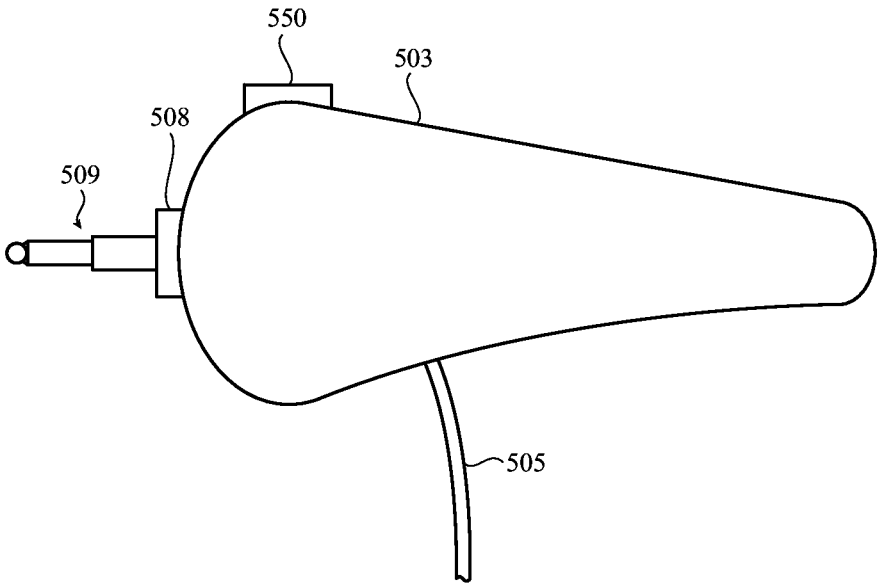
FIG. 5A is a side view of an alternative embodiment of the affixing structure of FIG. 2A.
Figure 5B:
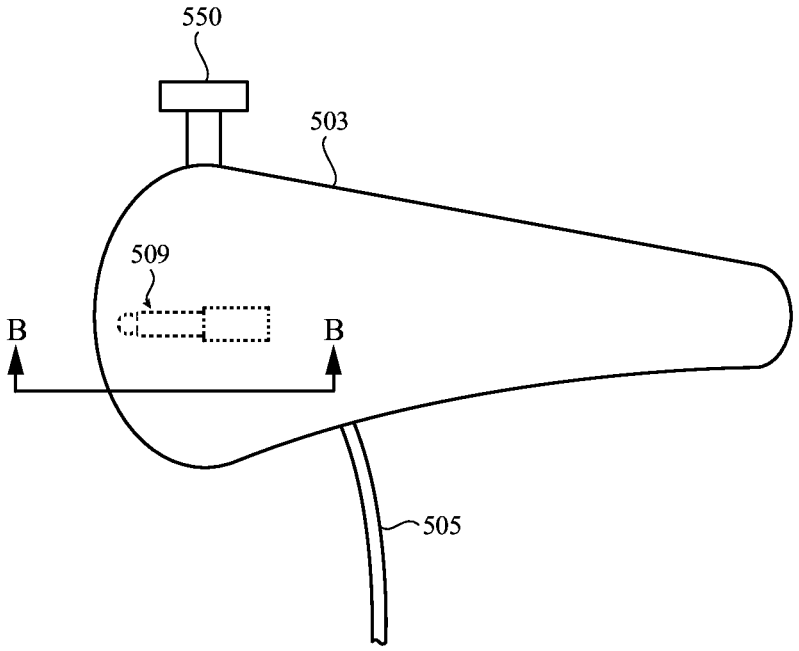
FIG. 5B shows the view of FIG. 5A after a group of spring pins are retracted.

FIG. 5A is a side view of an alternative embodiment of the connector of FIG. 2A. As illustrated, in this embodiment the connector plug may be incorporated into the connector lug 503. As also illustrated, the spring pins 509 mounted to the spring pin block 508 may be operable to project from and at least partially retract into the connector lug 503 (see FIG. 5B) using a knob 550 (shown as depressible though other manipulation mechanisms are possible and contemplated without departing from the scope of the present disclosure) that controls one or more extender/retraction mechanisms. Using such an implementation, the connector may connect the electrical conduit 505 (and/or other electrical conduit and/or attachment member) to the wearable device 101 by attaching the connector lug 503 to the lug interface channel 104 and manipulating the knob 550 to project the spring pins 509 from the connector lug 503. Similarly, the connector may disconnect the flex circuit 205 (and/or other electrical conduit and/or attachment member) from the wearable device 101 by manipulating the knob 550 to retract the spring pins 509 into the connector lug 503 and by detaching the connector lug 503 from the lug interface channel 104.

Figure 5C:
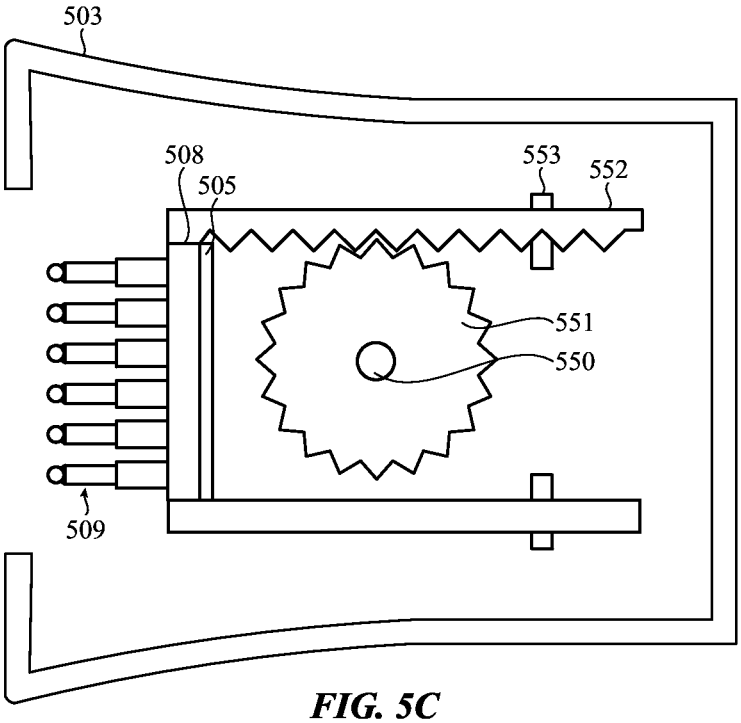
FIG. 5C is a cross sectional view of a first implementation of the alternative embodiment of the affixing structure of FIG. 5A, taken along line B-B of FIG. 5A.

FIG. 5C is a cross sectional view of a first implementation of the alternative embodiment of the connector of FIG. 5A, taken along line B-B of FIG. 5A. As shown, the shape of the wall of the connector lug 503 is simplified for purposes of illustration. As illustrated, the spring pin block 508 may be connected to rails 552 that are operable to move within brackets 553. The knob 550 may be coupled to a gear mechanism 551 that interacts with the gears on a geared one of the rails 552. Manipulation of the knob 550 may turn the gear mechanism 551, moving the geared one of the rails 552 and thereby the spring pin block 508 toward either projecting the spring pins 509 from the connector lug 503 or at least partially retracting the spring pins 509 into the connector lug 503.

Figure 5D:
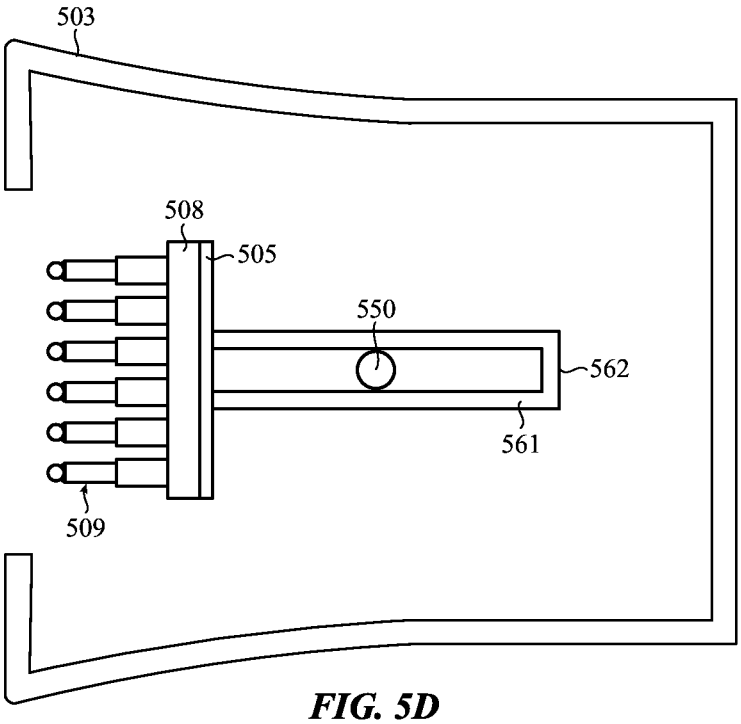
FIG. 5D is a cross sectional view of a second implementation of the alternative embodiment of the affixing structure of FIG. 5A, taken along line B-B of FIG. 5A.

FIG. 5D is a cross sectional view of a second implementation of the alternative embodiment of the connector of FIG. 5A, taken along line B-B of FIG. 5A. As shown, the shape of the wall of connector lug 503 is simplified for purposes of illustration. As illustrated, the spring pin block 508 may be connected to a sliding rail 561 operable to move within a track 562. The knob 550 may be coupled to the sliding rail 561 and thus be operated to move the sliding rail 561 within the track 562, thereby moving the spring pin block 508 toward either projecting the spring pins 509 from the connector lug 503 or at least partially retracting the spring pins 509 into the connector lug 503.

Although FIGS. 5C and 5D illustrate various mechanisms for projecting the spring pins 509 from and retracting the spring pins 509 at least partially into the connector lug 503, it is understood that these are examples. In various implementations, other mechanisms may be utilized without departing from the scope of the present disclosure.

Figure 6A:
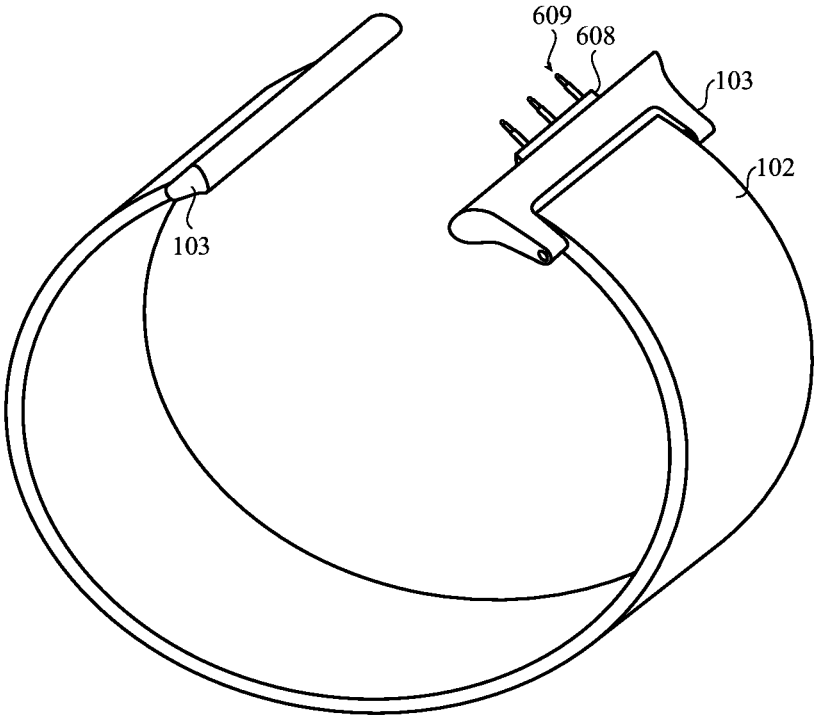
FIG. 6A is an isometric view of an example electronic attachment member and connector that may be utilized with the electronic device of FIG. 2A.

FIG. 6A is an isometric view of an example electronic attachment member 102 that may be utilized with the wearable device 101 or other electronic device of FIG. 2A. As illustrated, the attachment member 102 may be a band and/or a band segment (such as a link) that includes a pin block 608 with spring pins 609. The attachment member 102 may include one or more electronic components (such as one or more batteries, processing units, memories and/or other storage media, communication components, user interface components, and/or any other electronic components) (not shown) electrically connected to the spring pins 609. As such, coupling the attachment member 102 to the lug interface channels 104 of the wearable device 101 may electrically connect the electronic component(s) of the attachment member 102 to the wearable device 101 and/or one or more electronic components of the wearable device 101 via the access aperture 107 and the contact pads 214. This may allow the wearable device 101 to be supplemented by one or more functionalities available via one or more electronic components of the attachment member 102.

Although FIG. 6A illustrates the attachment member 102 as including a pin block 608 and three spring pins 609, it is understood that this is an example and that other configurations are possible and contemplated without departing from the scope of the present disclosure. Various implementations may utilize spring pins 609 without the pin block 608, other numbers of spring pins 609, conductors other than spring pins 609, and so on.

In various implementations, a number of different attachment members or bands (such as the example attachment members 102 of FIGS. 2A and 6A as well as other attachment members or bands) may be used with the wearable device 101 of FIG. 2A. Some of these different attachment members or bands may include the connection structure shown in FIG. 6A. Such connection structure may be used to obtain diagnostic or other information as well, instruct the wearable device to perform various diagnostic or other activities, and so on. This connection structure may also be used to transfer data and/or perform other activities.

In some implementations, the wearable device 101 may be attachable to multiple different bands. A first band may not include any electronic components and may not include the connection structure illustrated in FIG. 6A. A second band may include the connection structure shown in FIG. 6A and may be used to connect the wearable device 101 to a diagnostic device. A third band may include the connection structure shown in FIG. 6A and one or more electronic components. The connection structure for this third band may be utilized to enable interaction between electronic components of the wearable device 101 and those of the band.

In some cases, a band configured as shown in FIG. 6A may include an interconnection structure located elsewhere on the band other than the connection structure shown. The interconnection structure may be electrically connected to the connection structure shown and signals may be routed between the connection structure shown and the interconnection structure. In this way, the interconnection structure may supply interconnection via the shown connection structure at a location of the band that is more conveniently accessed than the shown connection structure.

Figure 6B:
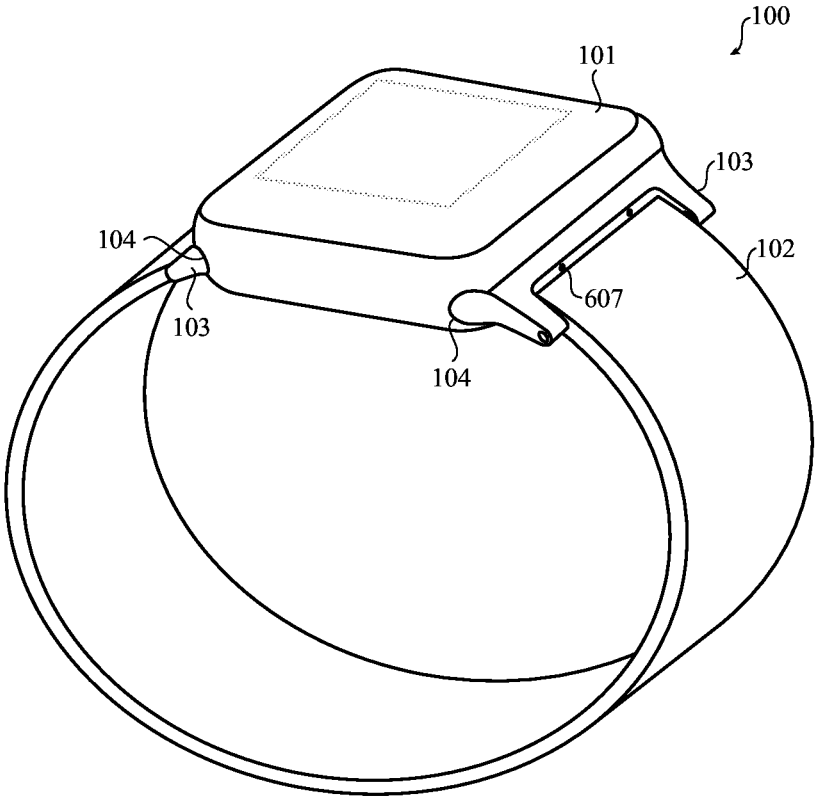
FIG. 6B is an isometric view of another embodiment of the example electronic attachment member and connector of FIG. 6A, attached to a sample electronic device.

For example, FIG. 6B is an isometric view of another embodiment of the example electronic attachment member 102 and connector of FIG. 6A, attached to a sample wearable device 101. Contrasted with the embodiment shown in FIG. 6A, this embodiment may include an interconnection structure 607 positioned on an exterior surface of the lug 103. As shown, the interconnection structure 607 may include contacts or other conductive elements that are electrically connected to one or more of the spring pins 609, enabling electrical access to one or more of the spring pins 609 while the lug 103 is attached to lug interface channels 104 of the sample wearable device 101.

Figure 7:
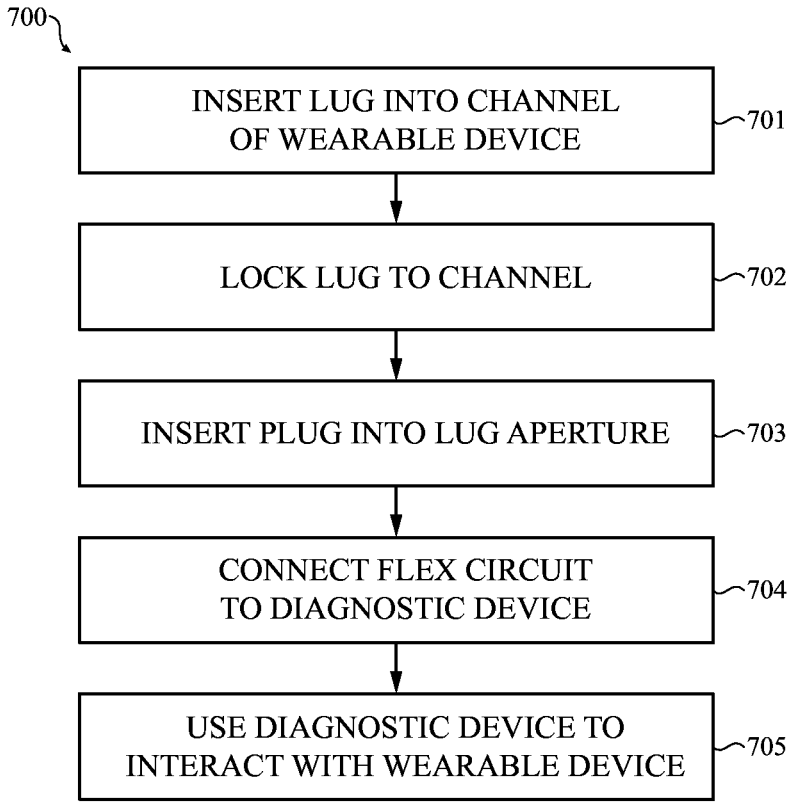
FIG. 7 is a flow chart illustrating an example method for connecting a diagnostic device to a wearable device. This method may be performed using the example system of FIG. 2A.

FIG. 7 is a flow chart illustrating an example method 700 for connecting a diagnostic device to a wearable device. This method 700 may be performed using the example system 200 of FIG. 2A.

The flow may begin at block 701 where a lug or other affixing structure may be inserted into a channel or other affixing structure interface of a wearable device. The flow may proceed to block 702 where the lug may be locked to the channel.

Next, the flow may proceed to block 703 where a plug may be inserted into an aperture of the lug. The plug may include spring pins or other conductors that electrically connect to a flex circuit or other electrical conduit. Upon insertion of the plug into the aperture, the spring pins may electrically connect to the wearable device and/or one or more electronic components of the wearable device through an aperture in the channel.

The flow may proceed to block 704 where the flex circuit may be connected to a diagnostic device. Finally, the flow may proceed to block 705 where the diagnostic device may be used to interact with the wearable device.

Although the example method 700 is illustrated and described above as including particular operations performed in a particular order, it is understood that this is an example. In various implementations, various orders of the same, similar, and/or different operations may be performed without departing from the scope of the present disclosure.

For example, the method 700 is illustrated and described above as including operations 704 and 705. However, in various implementations these operations may be omitted without departing from the scope of the present disclosure.

Figure 8:
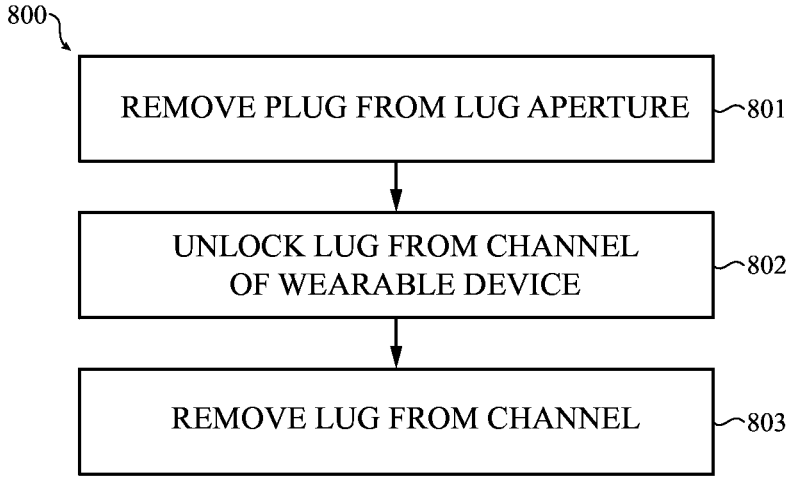
FIG. 8 is a flow chart illustrating an example method for disconnecting a connector from a wearable device. This method may be performed using the system of FIG. 2A.

FIG. 8 is a flow chart illustrating an example method for 800 disconnecting a connector from a wearable device. This method 800 may be performed using the system 200 of FIG. 2A.

The flow may begin at block 801 where a plug may be removed from a lug aperture of a lug or other affixing structure coupled to a channel or other affixing structure interface of a wearable device. The plug may include spring pins or other conductors that electrically connect to a flex circuit or other electrical conduit. Prior to removal of the plug from the aperture, the spring pins may electrically connect to the wearable device and/or one or more electronic components of the wearable device through an aperture in the channel.

The flow may then proceed to block 802 where the lug may be unlocked from the channel of the wearable device. Next, the flow may proceed to block 803 where the lug may be removed from the channel.

Although the example method 800 is illustrated and described above as including particular operations performed in a particular order, it is understood that this is an example. In various implementations, various orders of the same, similar, and/or different operations may be performed without departing from the scope of the present disclosure.

For example, block 802 is illustrated and described above as unlocking the lug from the channel of the wearable device. However, in various implementations the lug may not lock to the channel. In such implementations, block 802 may be omitted.

Figure 9A:
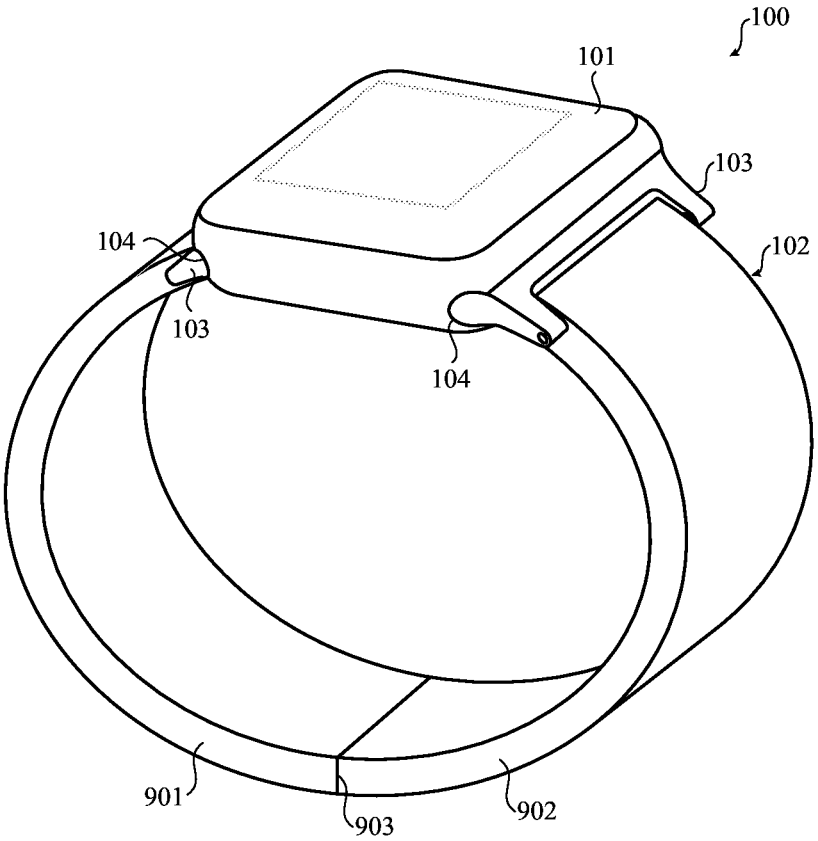
FIG. 9A is an isometric view of still another embodiment of the example electronic attachment member and connector of FIG. 6A, attached to a sample electronic device.

FIG. 9A is an isometric view of still another embodiment of the example electronic attachment member 102 and connector of FIG. 6A, attached to a sample wearable device 101. As illustrated, the attachment member 102 may be an electronic band that includes band segment portions 901 and 902 that are removably/releasably attachable via a clasp mechanism 903 and/or other joining technique.

Figure 9B:
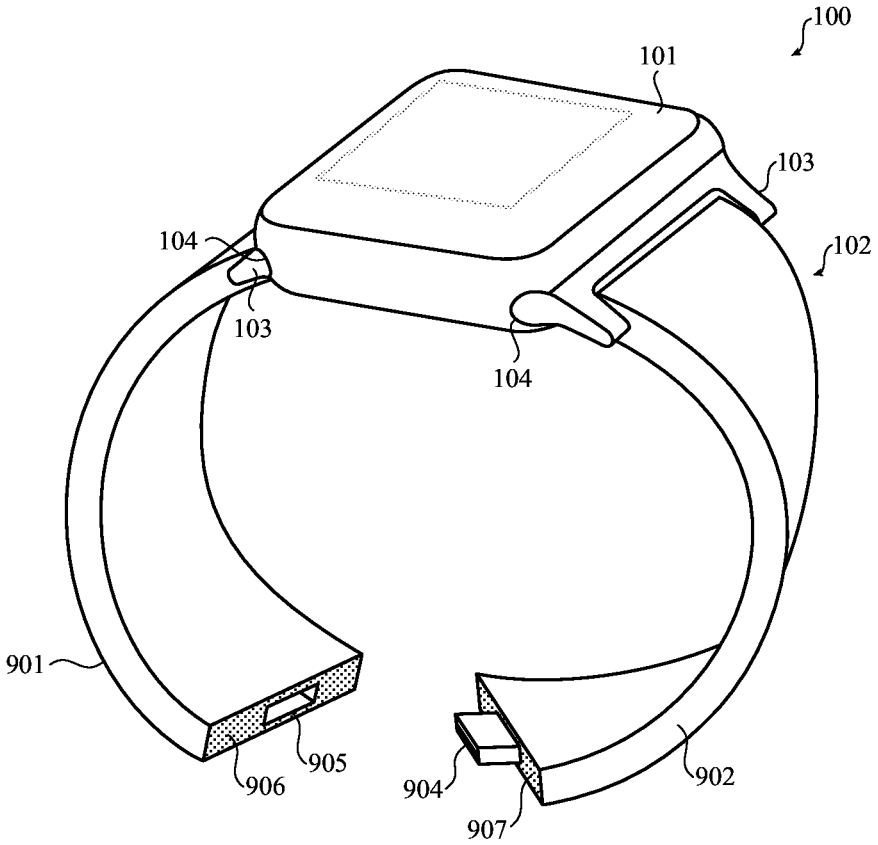
FIG. 9B shows the example electronic attachment member of FIG. 9A with the band portions detached from each other.

FIG. 9B shows the example electronic attachment member 102 of FIG. 9A with the band segment portions 901 and 902 detached from each other. As illustrated, the clasp mechanism 903 includes magnetic elements 906 and 907 (which may be one or more hard magnetic materials, soft magnetic materials, ferromagnetic materials, magnets, and so on) at the ends of the band segment portions 902. The magnetic elements 906 and 907 may attach (FIG. 9A) and detach (FIG. 9B) to allow the clasp mechanism 903 to removably/releasably attach the band segment portions 901 and 902.

As also illustrated, detaching the band segment portions 901 and 902 reveals a band connector 904 connected to the band segment portion 902. When the band segment portions 901 and 902 are attached as shown in FIG. 9A, the band connector 904 projects into a cavity 905 in the band segment portion 901 so as to be obscured. Then, when the band segment portions 901 and 902 are detached as shown in FIG. 9B, the band connector 904 is pulled from the cavity 905 so as to be revealed. Thus, the band connector 904 may be movable between an obscured position and a revealed position.

As shown, the band connector 904 may be positioned entirely in the cavity 905 when the band segment portions 901 and 902 are attached. The dimensions of the cavity 905 may be matched to the band connector 904 so that the band connector 904 fits snugly within the cavity 905. The fit between the cavity 905 and the band connector 904 may be tight enough in some examples that friction between the band connector 904 and the cavity 905 aids in keeping the band segment portions 901 and 902 attached unless sufficient force is exerted to overcome the frictional attachment and detach the band segment portions 901 and 902.

The band connector 904 may be operable to electrically connect the band segment portion 902 (and/or an electronic component of the band segment portion 902, the electronic attachment member 102 and/or a component thereof, and/or the wearable device 101) to another electronic device. This electrical connection may enable transmission of power and/or communication between the band segment portion 902 (and/or an electronic component of the band segment portion 902, the electronic attachment member 102 and/or a component thereof, and/or the wearable device 101 via the band segment portion 902) and the other electronic device. Such may allow the electronic device to provide power to and/or via the band segment portion 902, control various components of and/or via the band segment portion 902, allow various components of the electronic device to be controlled by and/or via the band segment portion 902 (thus supplementing the functionality of the band segment portion 902 and/or another device such as the wearable device 101 connected to the band segment portion 902), transfer data with and/or via the band segment portion 902, and so on.

Figure 9C:
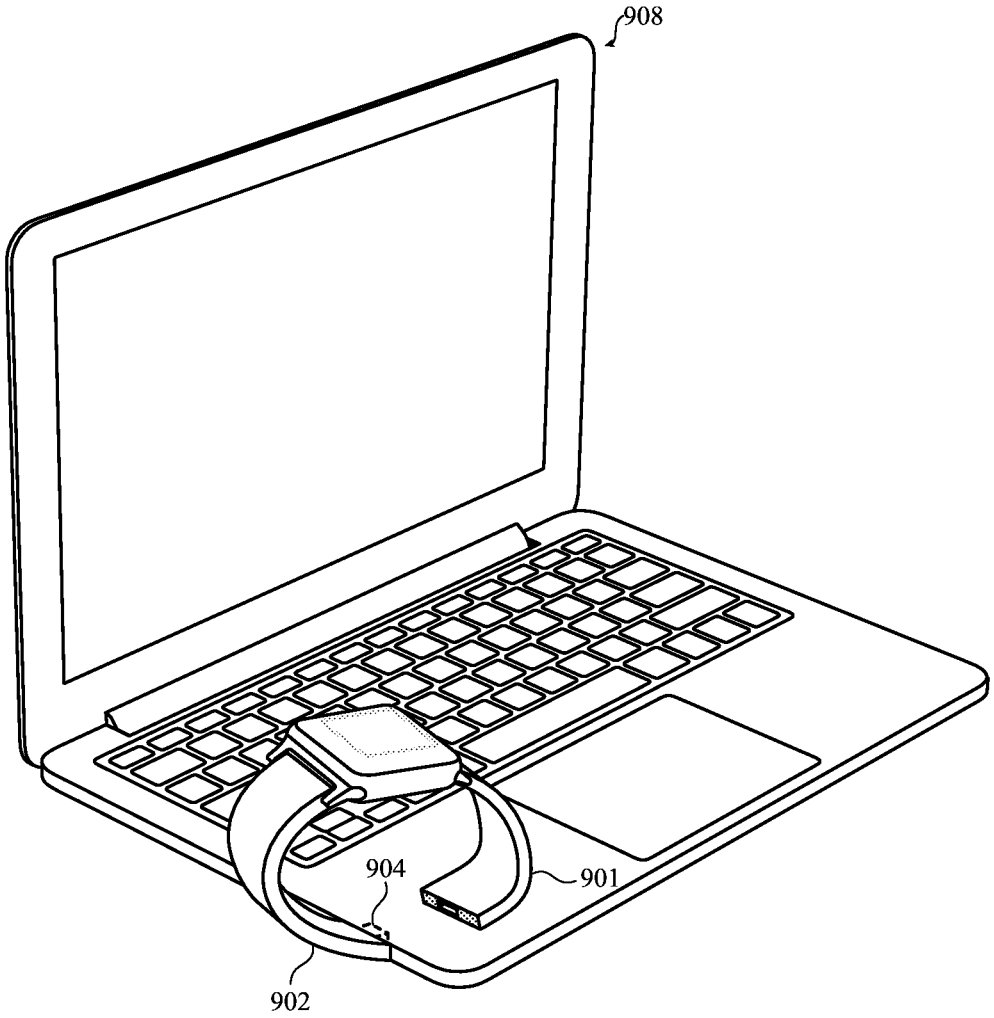
FIG. 9C shows the example electronic attachment member of FIG. 9B with the band connector connected to a computing device.

For example, FIG. 9C shows the example electronic attachment member 102 of FIG. 9B with the band connector 904 connected to a computing device 908. This configuration may allow power from the computing device 908 to be provided to the band segment portion 902, a component of the band segment portion 902 (such as a battery for the purpose of charging the battery), the wearable device 101, a component of the wearable device 101 (such as a battery for the purpose of charging the battery) and so on. This configuration may also allow data to be transmitted between the computing device 908 and the band segment portion 902 (and/or via the band segment portion 902) to allow transfer of files and/or other data, remote commands, software and/or other updates, and so on.

Although the computing device 908 is illustrated as a laptop computing device, it is understood that this is an example. In various implementations, the computing device 908 may be any kind of computing device such as a cellular telephone, a wearable device, a desktop computing device, a tablet computing device, a digital media player, a mobile computing device, a smart phone, and so on.

Figure 9D:
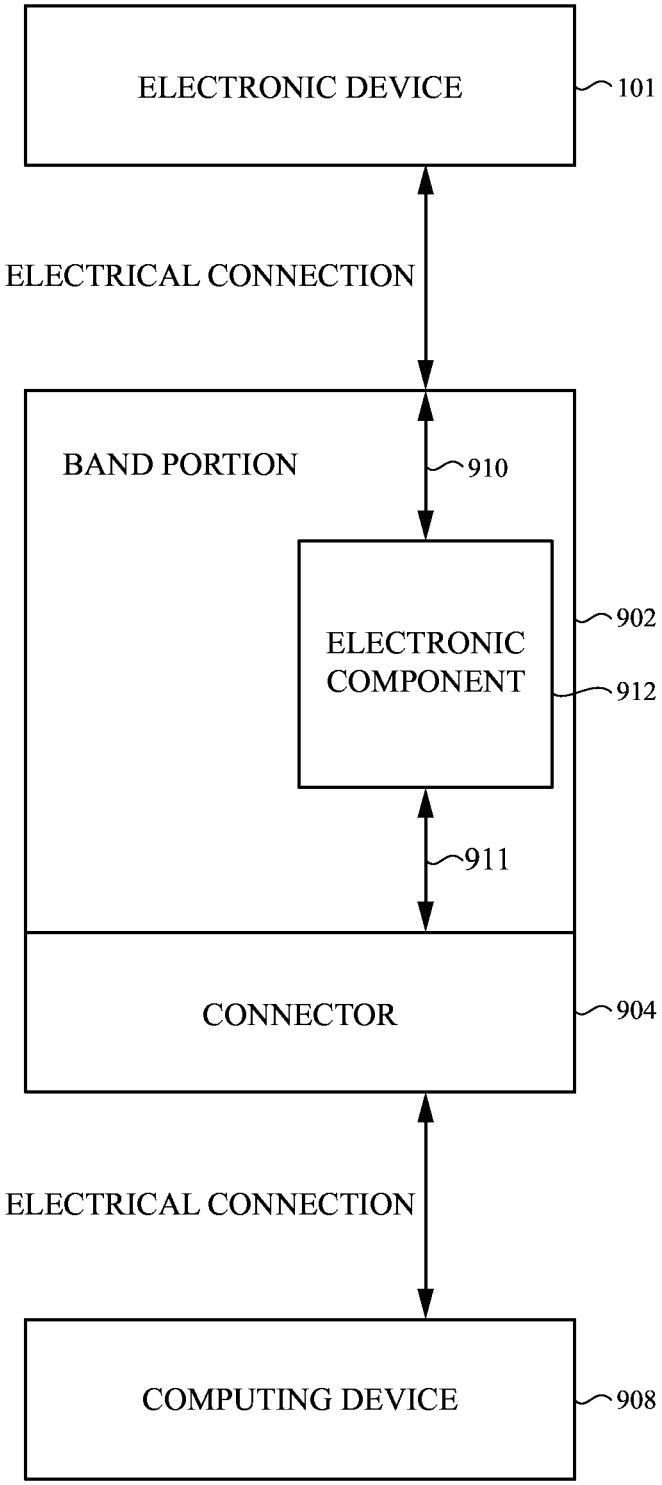
FIG. 9D is a block diagram illustrating electrical connection between the wearable device or other electronic device and computing device of FIG. 9C via the band segment portion and the band connector.

FIG. 9D is a block diagram illustrating electrical connection between the wearable device 101 or other electronic device and computing device 908 of FIG. 9C via band segment portion 902 and the band connector 904. As illustrated, the wearable device 101 or other electronic device may be electrically connected to the band segment portion 902 (such as via the such as via the contact pads 214 and the spring pins 609 and/or via other electrical connection mechanisms) and the band segment portion 902 may be electrically connected to the computing device 908 via the band connector 904. As also illustrated, the band segment portion 902 may include conductive material 910 and 911 that electrically connects the electrical connection between the wearable device 101 or other electronic device and the band segment portion 902 and the electrical connection between the band connector 904 and the computing device 908.

As illustrated, the conductive material 910 and 911 may be coupled via one or more electronic components 912 (such as one or more batteries operable to power the band segment portion 902 and/or the wearable device 101 and/or other electronic device, processing units, memories and/or other storage media, communication components, user interface components, and/or any other electronic components). However, it is understood that this is an example. In various implementations, the conductive materials 910 and 911 may be directly joined (the band segment portion 902 not including other electronic components other than the conductive materials 910 and 911 in such implementations) without departing from the scope of the present disclosure.

Figure 9E:
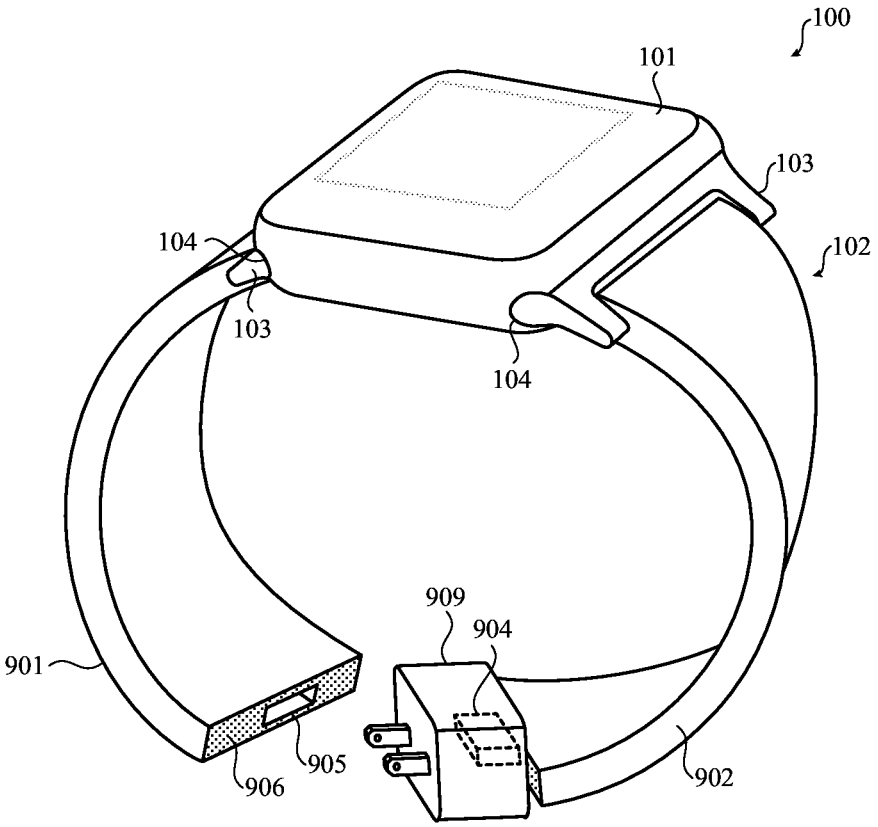
FIG. 9E shows the example electronic attachment member of FIG. 9B with the band connector connected to a charger.

FIG. 9E shows the example electronic attachment member 102 of FIG. 9B with the band connector 904 connected to a charger 909. This configuration may allow power from the charger 909 to be provided to the band segment portion 902, a component of the band segment portion 902 (such as a battery for the purpose of charging the battery), the wearable device 101, a component of the wearable device 101 (such as a battery for the purpose of charging the battery) and so on.

Although various configurations of the electronic attachment member 102 and the band connector 904 are illustrated in FIGS. 9A-9E and described above, it is understood that these are examples. Various other configurations are possible and contemplated without departing from the scope of the present disclosure.

By way of a first example, the band connector 904 is described above as having an obscured position in FIG. 9A and a revealed position in FIG. 9B. However, in various implementations the band connector 904 may be unobscured in all and/or any possible positions.

In a second example, the electronic attachment member 102 is illustrated and described with respect to FIGS. 9A and 9B as including band segment portions 901 and 902 with a clasp mechanism 903 that includes the band connector 904. However, in some implementations the electronic attachment member 102 may or may not include multiple segments. Further, in various implementations the band connector 904 may be configured to fold out of a surface of the electronic attachment member 102 instead of being positioned at the end of the band segment portion 902.

In a third example, the band connector 904 is illustrated as a universal serial bus (USB) connector (or adapter) plug. However, in various implementations any kind of connector plug (such as an Institute of Electrical and Electronics Engineers 1394 connector plug, a Thunderbolt™ connector plug, a Lightning™ connector plug, an Ethernet connector plug, a High-Definition Multimedia Interface connector plug, a serial port connector plug, a parallel port connector plug, a Digital Visual Interface connector plug, a composite video connector plug, an S-Video connector plug, a video graphics array connector plug, a serial ATA connector plug, a SCSI connector plug, and/or any other connector plug) and/or any other electrical connection structure including conductive material without departing from the scope of the present disclosure.

By way of a fourth example, the magnetic elements 906 and 907 are illustrated and described with respect to FIG. 9B as distinct from the band connector 904. However, in various implementations the band connector 904 itself may include one or more of the magnetic elements 906 and 907 and/or other magnetic mechanisms that are configured to removably attach and/or electrically connect various components.

Although a particular clasp mechanism 903 is illustrated and described with respect to FIGS. 9A-9B, providing a particular implementation of obscured and revealed positions for the band connector 904, it is understood that these are examples. In various implementations, other clasp mechanisms 903 may be utilized that may provide the same, similar, and/or different obscured and revealed positions for a band connector 904.

Figure 10A:
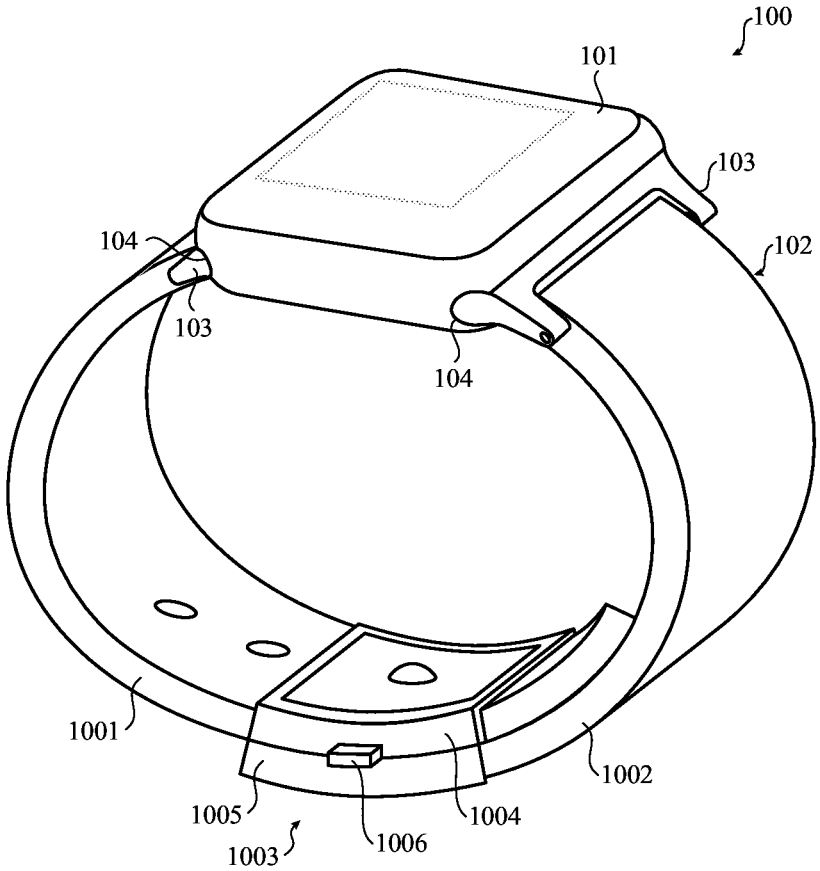
FIG. 10A is an isometric view of yet another embodiment of the example electronic attachment member and connector of FIG. 6A, attached to a sample electronic device.
Figure 10B:
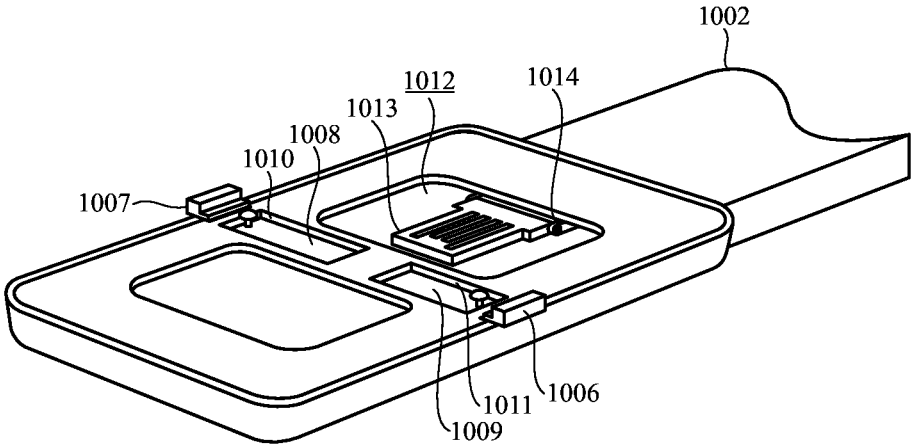
FIG. 10B shows the example electronic attachment member of FIG. 10A with the band portions detached from each other.

For example, FIGS. 10A-10B illustrate another implementation of a clasp mechanism 1003. As shown in FIG. 10A, the clasp mechanism 1003 may include a first clasp portion 1004 that couples to a second clasp portion 1005. The clasp mechanism 1003 may also include one or more manipulation mechanisms 1006 and 1007 (see FIG. 10B) that aid in decoupling the first and second clasp portions 1004 and 1005.

In some implementations of this example, each of the first and second clasp portions 1004 and 1005 may include one or more magnets (not shown). The magnets of the second clasp portion 1005 may be moveable between a first and second position utilizing the manipulation mechanisms 1006 and 1007. In the first position, the magnets of the first and second clasp portions 1004 and 1005 may be configured with polarities that attract each other to attach the first and second clasp portions 1004 and 1005. In the second position, the magnets of the second clasp portion 1005 may move such that the polarities are no longer aligned so that the first and second clasp portions 1004 and 1005 may be separated. In some cases, the polarities may repel in the second position to force the first and second clasp portions 1004 and 1005 to separate. The magnets of the second clasp portion 1005 may be biased toward the first position and may be moved to the second position using the manipulation mechanisms 1006 and 1007. However, it is understood that this is also an example. In various other implementations, one or more mechanical mechanisms may be used to couple the first and second clasp portions 1004 and 1005 instead and/or in addition to magnets and/or to decouple and/or aid in decoupling the first and second clasp portions 1004 and 1005.

FIG. 10B illustrates the first and second clasp portions 1004 and 1005 separated. As shown, the manipulation mechanisms 1006 and 1007 may be connected to moveable members 1008 and 1009. Magnets of the second clasp portion 1005 may be position within (and/or under and so on) the moveable members 1008 and 1009. The moveable members 1008 and 1009 may be operable to respectively move within channels 1010 and 1011 in response to movement of the manipulation mechanisms 1006 and 1007. As also illustrated, the second clasp portion 1005 may include a cavity 1012 in which a band connector 1013 may be positioned. Thus, the band connector 1013 may be transitioned between an obscured position (FIG. 10A) and a revealed position (FIG. 10B) by coupling and decoupling the first and second clasp portions 1004 and 1005.

Figure 10C:
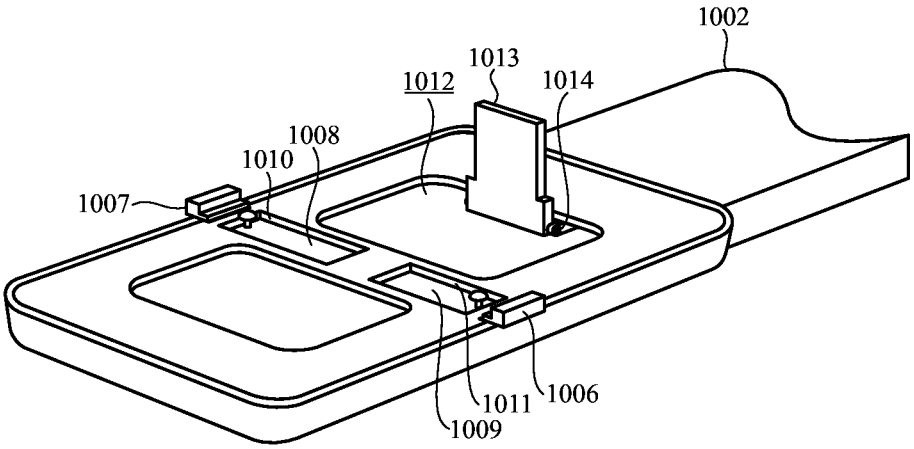
FIG. 10C shows the example electronic attachment member of FIG. 10B with the band connector in a projected position.

Further, the band connector 1013 may be moveable on a hinge 1014 between a projected position and a withdrawn position. The withdrawn position is illustrated in FIG. 10B and the projected position is illustrated in FIG. 10C. The band connector 1013 may be moveable on the hinge 1014 to be positioned flat against the second clasp portion 1005 in the withdrawn position so that the first and second clasp portions 1004 and 1005 may be coupled without interference from the band connector 1013. Conversely, the band connector 1013 may be moveable on the hinge 1014 to be positioned proud of the second clasp portion 1005 in the projected position so that the band connector 1013 may be connected to another electronic device (such as a charging adapter, a computing device, and so on).

The band connector 1013 is illustrated as a thin USB plug. However, it is understood that this is an example. In various implementations the band connector 1013 may be any kind of connector plug and/or other electrical connection structure without departing from the scope of the present disclosure.

Figure 11A:
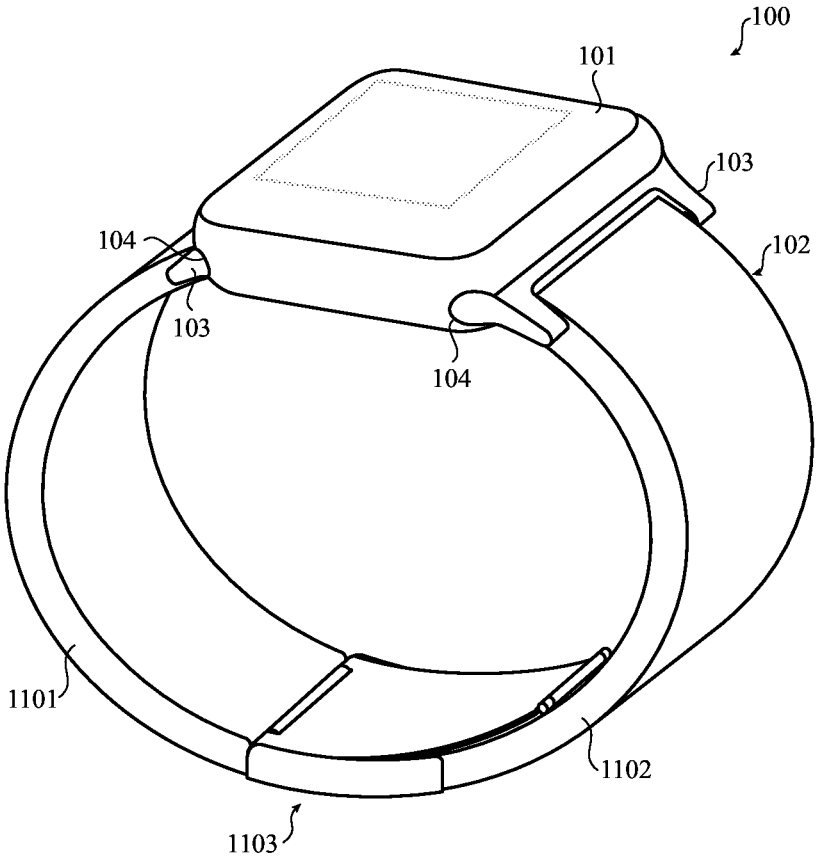
FIG. 11A is an isometric view of still another embodiment of the example electronic attachment member and connector of FIG. 6A, attached to a sample electronic device.
Figure 11B:
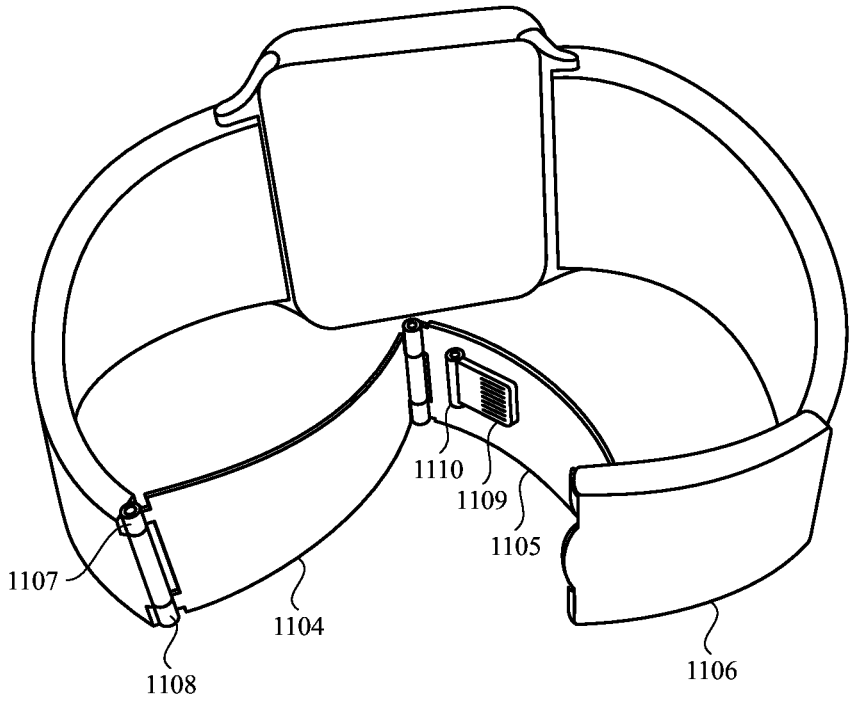
FIG. 11B shows the example electronic attachment member of FIG. 11A with the clasp mechanism unfastened.

By way of another example, FIGS. 11A-11B illustrate another implementation of a clasp mechanism 1103. As shown in FIG. 11A, the band segment portions 1101 and 1102 may be connected by a clasp mechanism 1103. As illustrated in FIG. 11B, the clasp mechanism 1103 may not detach but may instead operate to extend. FIG. 11A illustrates the clasp mechanism 1103 in a fastened configuration and FIG. 11B illustrated the clasp mechanism in an extended configuration.

As illustrated, the clasp mechanism 1103 may include a first extender portion 1104, a second extender portion 1105, and a fastening portion 1106. The first extender portion 1104 may be flexibly connected (such as by hinges or other flexible and/or rotatable connection mechanism) to the band segment portion 1101 and the second extender portion 1105. Similarly, the second extender portion 1105 may be flexibly connected to the fastening portion 1106, which may in turn be flexibly connected to the band segment portion 1102. The first extender portion 1104, the second extender portion 1105, and the fastening portion 1106 may move with respect to each other when the clasp mechanism is transitioned from the extended configuration to the fastened configuration such that the first and second extender portions fold into the fastening portion 1106. The fastening portion 1106 may include edges 1108 that clasp protrusions 1107 of the first extender portion 1104 to retain the clasp mechanism 1103 in the fastened configuration unless force is exerted on the fastening portion 1106 sufficient to pull the edges 1108 off of the protrusions 1107. Unfastening the fastening portion 1106 in this way may allow the clasp mechanism to be transitioned from the fastened configuration to the extended configuration.

As also illustrated, the a band connector 1109 may be moveably coupled to the second extender portion 1104 by a hinge 1110. Thus, the band connector 1013 may be transitioned between an obscured position (FIG. 11A) and a revealed position (FIG. 11B) by transitioning the clasp mechanism 1103 between the fastened and extended configurations.

Figure 11C:
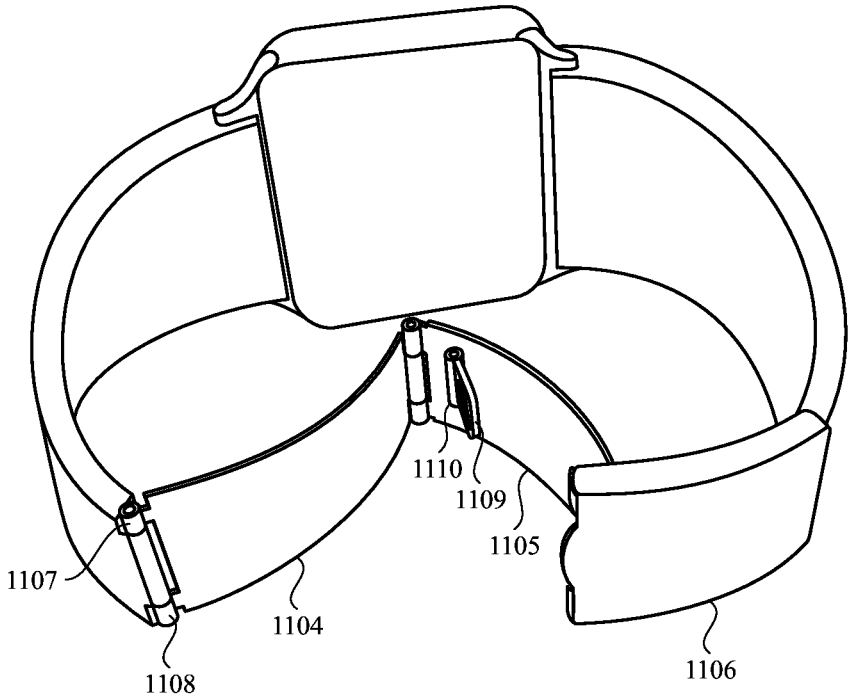
FIG. 11C shows the example electronic attachment member of FIG. 11B with the band connector in a projected position.

Further, the band connector 1109 may be moveable on the hinge 1110 between a flush position and a projected position. The flush position is illustrated in FIG. 11B and the projected position is illustrated in FIG. 11C. The band connector 1109 may be moveable on the hinge 1110 to be positioned flat against the second extender portion 1105 in the flush position so that the first and extender portions 1104 and 1105 may fold into the fastening portion 1106 without interference from the band connector 1109. Conversely, the band connector 1109 may be moveable on the hinge 1110 to be positioned proud of the second extender portion 1105 in the projected position so that the band connector 1109 may be connected to another electronic device (such as a charging adapter, a computing device, and so on).

The band connector 1109 is illustrated as a Lightning™ connector plug. However, it is understood that this is an example. In various implementations the band connector 1109 may be any kind of connector plug and/or other electrical connection structure without departing from the scope of the present disclosure.

Although particular examples of clasp mechanisms 903, 1003, and 1103 and band connectors 904, 1013, and 1109 have been illustrated and described above with respect to FIGS. 9A-9E, 10A-10C, and 11A-11C, it is understood that these are examples. In various implementations, other clasp mechanisms and/or other band connectors that may be variously connected to be transitionable between obscured and revealed positions may be utilized without departing from the present disclosure.

As discussed above and illustrated in the accompanying figures, the present disclosure systems, apparatuses, and methods related to connectors for portable electronic devices. In various embodiments, an affixing structure ("lug") of a connector may be configured to attach to an affixing structure interface ("lug interface") of an electronic device that is configured to also couple the electronic device to an attachment member, such as a band. Conductors of the connector may electrically connect to the electronic device when the affixing structure is attached, facilitating electrical communication between the electronic device and another electronic device using the connector. This electrical communication may enable a variety of different interactions with the electronic device, such as obtaining data from the electronic device, transferring data to the electronic device, obtaining diagnostic information from the electronic device, instructing the electronic device to perform various actions such as running diagnostic tests, and so on.

In some embodiments, an attachment member may include one or more electronic components and spring pins or other conductors. For example, inserting an affixing structure of a band or band segment to a channel of a wearable device may electrically connect spring pins of the band affixing structure to the wearable device, thereby electrically connecting the electronic component of the band or band segment to the electronic component of the wearable device. In some embodiments, the attachment member may additionally include a connector operable to connect the wearable device to another electronic device. Such connection may allow transfer of power and/or communications between the attachment member and the electronic device and/or between the wearable device and the electronic device via the attachment member.

In the present disclosure, the methods disclosed may be implemented utilizing sets of instructions or software readable by a device. Further, it is understood that the specific order or hierarchy of steps in the methods disclosed are examples of sample approaches. In other embodiments, the specific order or hierarchy of steps in the method can be rearranged while remaining within the disclosed subject matter. The accompanying method claims present elements of the various steps in a sample order, and are not necessarily meant to be limited to the specific order or hierarchy presented.

The described disclosure may utilize a computer program product, or software, that may include a non-transitory machine-readable medium having stored thereon instructions, which may be used to program a computer system (or other electronic devices) to perform a process according to the present disclosure such as a computer controlled manufacturing process. A non-transitory machine-readable medium includes any mechanism for storing information in a form (e.g., software, processing application) readable by a machine (e.g., a computer). The non-transitory machine-readable medium may take the form of, but is not limited to, a magnetic storage medium (e.g., floppy diskette, video cassette, and so on); optical storage medium (e.g., CD-ROM); magneto-optical storage medium; read only memory (ROM); random access memory (RAM); erasable programmable memory (e.g., EPROM and EEPROM); flash memory; and so on.

It is believed that the present disclosure and many of its attendant advantages will be understood by the foregoing description, and it will be apparent that various changes may be made in the form, construction and arrangement of the components without departing from the disclosed subject matter or without sacrificing all of its material advantages. The form described is merely explanatory, and it is the intention of the following claims to encompass and include such changes.

While the present disclosure has been described with reference to various embodiments, it will be understood that these embodiments are illustrative and that the scope of the disclosure is not limited to them. Many variations, modifications, additions, and improvements are possible. More generally, embodiments in accordance with the present disclosure have been described in the context or particular embodiments. Functionality may be separated or combined in blocks differently in various embodiments of the disclosure or described with different terminology. These and other variations, modifications, additions, and improvements may fall within the scope of the disclosure as defined in the claims that follow.

We claim:

1. An electronic band for a wearable device, comprising:
a band segment including an electronic component;
an affixing structure, coupled to the band segment, that couples the band segment to a wearable device when inserted into a channel of the wearable device; and
a conductor, coupled to the affixing structure, electrically connected to the electronic component of the band segment;
wherein the conductor electrically connects the electronic component of the band segment to an electronic component of the wearable device when the affixing structure is inserted into the channel.

2. The electronic band of claim 1, further comprising a connector coupled to the band segment and electrically connected to at least one of the conductor or the electronic component of the band segment, the connector electrically connects the band segment to an electronic device when the connector is coupled to the electronic device.

3. The electronic band of claim 2, wherein the connector is movable between an obscured position and a revealed position.

4. The electronic band of claim 3, wherein the band segment comprises a first portion and a second portion that are removably attachable.

5. The electronic band of claim 4, wherein the connector is in the obscured position when the first portion is attached to the second portion and the connector is in the revealed position when the first portion is detached from the second portion.

6. The electronic band of claim 4, wherein the first portion and the second portion are removably attachable via a magnet.

7. The electronic band of claim 6, wherein the magnet electrically connects the connector and the electronic device when the connector is connected to the electronic device.

8. The electronic band of claim 6, wherein the magnet electrically connects the first portion and the second portion when the first portion is attached to the second portion.

9. The electronic band of claim 4, wherein the connector is coupled to the first portion and is at least partially positioned in an aperture of the second portion in the obscured position.

10. The electronic band of claim 2, wherein the electronic band transfers at least one of power or data between the electronic device and the wearable device when the conductor is connected to the electronic component of the wearable device and the connector is connected to the electronic device.

11. A connector for a wearable electronic device, comprising:
a band that couples to a user to attach the wearable electronic device to the user, the band including an electrical conduit; and
an affixing structure coupled to the band, the affixing structure:
inserts into an interface of the wearable electronic device when coupling to the wearable electronic device; and
includes conductors coupled to the electrical conduit;
wherein:
the conductors electrically connect to an electronic component of the wearable electronic device when the affixing structure is inserted into the interface; and the electrical conduit electrically connect to an additional electronic component when the electrical conduit is coupled to the additional electronic component.

12. The connector of claim 11, wherein the conductors comprise spring pins.

13. The connector of claim 11, wherein the conductors electrically connect to the electronic component of the wearable electronic device when the affixing structure is inserted into the interface by projecting into an aperture of the interface to contact pads positioned in the aperture.

14. The connector of claim 11, further comprising at least one of:

a retraction mechanism that retracts the conductors at least partially into the affixing structure; or an extender mechanism that extends the conductors at least partially from the affixing structure.

15. The connector of claim 11, further comprising a locking mechanism that locks the affixing structure in place when attached to the interface.

16. The connector of claim 15, wherein the locking mechanism comprises at least one of:

tabs that frictionally engage the interface; or a structure that extends from a first hole defined in the interface into the affixing structure.

17. The connector of claim 11, wherein the interface comprises a channel and the affixing structure slides into the channel when coupling to the wearable electronic device.

18. The connector of claim 11, wherein the other electronic component is included in the band.

19. The connector of claim 18, wherein the band further includes a band connector that electrically connects an electronic device to at least one of the other electronic component or the electronic component of the wearable electronic device.

20. The connector of claim 11, wherein the wearable electronic device includes a metal housing and the conductors are electrically isolated from the metal housing when the affixing structure is inserted into the interface.

21. The connector of claim 11, wherein the electrical conduit and conductors are usable by the other electronic component to at least one of:

obtain data stored by the electronic component of the portable electronic device;

instruct the electronic component of the portable electronic device to perform an operation; or write data to the electronic component of the portable electronic device.

22. A wearable device connector, comprising:

an affixing structure that slides into a channel of the wearable device when coupling to the wearable electronic device;

an electrical conduit coupled to the affixing structure; and a terminal coupled to electrical conduit;

wherein the terminal electrically connects to an electronic component of the wearable device and the electrical conduit electrically connect to the electronic component when the affixing structure is slid into the channel.

23. The system of claim 22, wherein the electrical conduit comprises a band.

24. The system of claim 23, wherein the band includes a connector that is electrically connected to the terminal and connects to the electronic component.

25. The system of claim 24, wherein the band includes a first band portion that is releasably attachable to a second band portion.

26. The system of claim 25, wherein:

the connector is coupled to the first band portion;

the second band portion includes a cavity; and the connector at least partially inserts into the cavity when the first band portion is attached to the second band portion.

27. The system of claim 25, wherein first band portion is releasably attachable to the second band portion using a magnet.

28. The system of claim 25, wherein the band transmits power between the wearable device and the electronic device when the affixing structure is slid into the channel and the connector is connected to the electronic component.

29. The system of claim 25, wherein the band transmits communications between the wearable device and the electronic device when the affixing structure is slid into the channel and the connector is connected to the electronic component.

* * * * *